US008961109B2

(12) United States Patent
Bertels

(10) Patent No.: US 8,961,109 B2
(45) Date of Patent: Feb. 24, 2015

(54) FAN

(75) Inventor: Augustinus Wilhelmus Maria Bertels, Doorwerth (NL)

(73) Assignee: Bronswerk Heat Transfer B.V., Nijkerk (NL)

( * ) Notice: Subject to any disclaimer, the term of this patent is extended or adjusted under 35 U.S.C. 154(b) by 1279 days.

(21) Appl. No.: 12/681,231

(22) PCT Filed: Oct. 6, 2008

(86) PCT No.: PCT/NL2008/050637

§ 371 (c)(1),
(2), (4) Date: Jul. 7, 2010

(87) PCT Pub. No.: WO2009/045108

PCT Pub. Date: Apr. 9, 2009

(65) Prior Publication Data

US 2010/0290890 A1 Nov. 18, 2010

(30) Foreign Application Priority Data

Oct. 4, 2007 (NL) ..... 1034467

(51) Int. Cl.
*F04D 29/32* (2006.01)
*F04D 29/38* (2006.01)

(52) U.S. Cl.
CPC ..... *F04D 29/326* (2013.01); *F04D 29/325* (2013.01); *F04D 29/388* (2013.01)
USPC ..... 415/119; 415/121.2; 415/173.1; 415/173.6; 415/176; 415/220; 415/222; 415/223; 415/122.1; 415/124.1; 416/189; 416/190; 416/191; 416/195; 416/170 R; 416/226; 416/230; 416/233; 417/319; 417/321; 417/423.1; 417/423.5

(58) Field of Classification Search
USPC ..... 415/119, 121.2, 173.1, 173.6, 176, 220, 415/222, 223, 228, 122.1, 124.1; 416/189, 416/190, 191, 192, 194–195, 170 R, 226, 416/229 R, 229 A, 230, 233, 241 R, 241 A; 417/319, 321, 423.1, 423.5
See application file for complete search history.

(56) References Cited

U.S. PATENT DOCUMENTS

| | | | | |
|---|---|---|---|---|
| 1,304,793 A * | 5/1919 | Moore | ..... | 416/191 |
| 1,541,776 A | 6/1925 | Mercer | | |
| 1,852,622 A * | 4/1932 | Milburn | ..... | 244/123.8 |
| 2,116,953 A * | 5/1938 | Sambraus | ..... | 244/131 |

(Continued)

FOREIGN PATENT DOCUMENTS

| | | |
|---|---|---|
| NL | 9402191 A | 8/1996 |
| WO | 9619669 A1 | 6/1996 |

*Primary Examiner* — Christopher Verdier
(74) *Attorney, Agent, or Firm* — The Webb Law Firm

(57) ABSTRACT

A fan includes a frame, rotor supported by this frame and having a central hub and a number of blades and a drive mechanism for rotatably driving the rotor, in addition to a ring to which the end zones of the blades are connected. The ring is assembled from two part-rings of the same form which each include a circular strip of sheet material, the free ends of which are mutually connected to form the outer surface of a truncated cone, and a third part-ring which mutually connects the inner edges of the first two part-rings. The end zones of the blades are connected to the third part-ring. The ring has a diameter of more than about 1.50 m. The number of blades amounts to at least eight. The blades are hollow and include a framework structure which is provided with a skin connected thereto.

34 Claims, 28 Drawing Sheets

(56) References Cited

U.S. PATENT DOCUMENTS

| | | | | | |
|---|---|---|---|---|---|
| 2,342,421 | A | | 2/1944 | Moore | |
| 2,682,925 | A | | 7/1954 | Wosika | |
| 4,685,513 | A | * | 8/1987 | Longhouse et al. | 415/222 |
| 4,789,302 | A | * | 12/1988 | Gruzling | 416/189 |
| 5,040,945 | A | * | 8/1991 | Levesque | 415/124.1 |
| 5,042,968 | A | * | 8/1991 | Fecto | 416/226 |
| 5,332,178 | A | * | 7/1994 | Williams | 416/226 |
| 5,860,788 | A | * | 1/1999 | Sorensen | 416/189 |
| 6,328,529 | B1 | * | 12/2001 | Yamaguchi et al. | 415/228 |
| 2009/0191063 | A1 | * | 7/2009 | Baker et al. | 416/227 R |

* cited by examiner

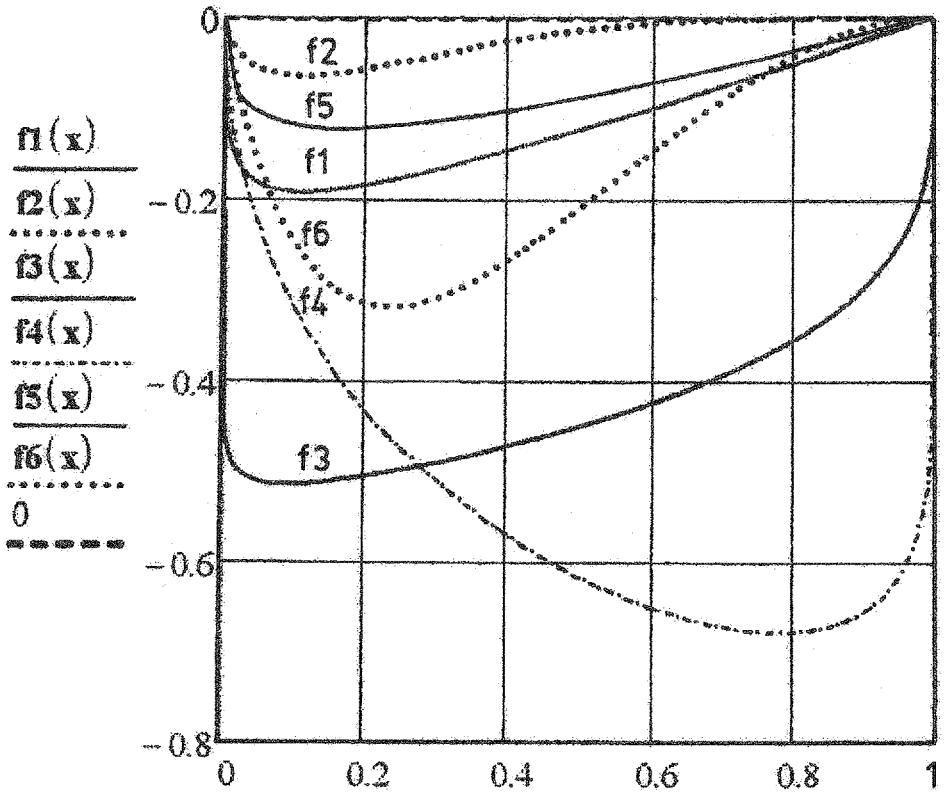

$$F(I,x) := (-K1(I)) \bullet (|x|)^{N1(I)} \bullet \left(1 - x^{N2(I)}\right)^{N3(I)}$$

$$f1(x) := -C1 \bullet \left(x^{0.25}\right) \bullet \left(1 - x^{0.5}\right)^{1} \qquad C1 := -0.5$$

$$f2(x) := -C2 \bullet (x)^{0.5} \bullet \left(1 - x^{1}\right)^{4} \qquad C2 := 0.3$$

$$f3(x) := -C3 \bullet (x)^{0.075} \bullet \left(1 - x^{0.25}\right)^{0.25} \qquad C3 := 0.750$$

fig.9

$$f4(x) := -C4 \bullet (x)^{0.5} \bullet \left(1 - x^{0.05}\right)^{0.125} \qquad C4 := 1.4$$

$$f5(x) := -C5 \bullet (x)^{0.5} \bullet \left(1 - x^{0.125}\right)^{1} \qquad C5 := 1.5$$

$$f6(x) := -C6 \bullet (x)^{0.95} \bullet \left(1 - x^{0.5}\right)^{2} \qquad C6 := 4.75$$

FAN

BACKGROUND OF THE INVENTION

1. Field of the invention

The invention relates to a fan that includes:

a frame;

a rotor supported rotatably by this frame and having a central hub; and a number of substantially similar blades which are connected to this hub in angularly equidistant arrangement and extend at least more or less in radial direction, which blades have an aerodynamic form such that during rotary driving of the rotor round the axis of the hub an air displacement occurs; and drive means for rotatably driving the blades with the hub around the axis of the hub;

a ring to which the end zones of the blades are connected.

2. Description of Related Art

Such a fan is known, for instance from NL-A-9402191. Known are small fans for household use right up to very large fans used to ventilate enclosed spaces, for instance buildings, for air-conditioning systems, cold-storage plants, air tunnels and the like.

SUMMARY OF THE INVENTION

The invention has for its object to provide a fan which, depending on the wishes of the end user and the designer, can have a very large diameter but nevertheless has a rotor which is extremely light but still stiff, and which has a very stable form.

It is a further object of the invention to provide a fan which can be manufactured with relatively simple means at very low cost compared to known fans.

Another object of the invention is to provide a fan which delivers extremely good performance in terms of aerodynamic efficiency and, compared to the prior art under similar conditions, has very low noise production.

It is a final object of the invention to provide a fan which can be manufactured with a small tolerance such that it is not necessary to balance the rotor after manufacture in order to eliminate imbalance.

As used herein through the specification, the term "means" is synonymous with the term "mechanism."

With a view to the above stated objectives the invention generally provides a fan of the type stated in the preamble which has the feature that the ring is assembled from two part-rings of the same form which each consist of a strip of sheet material with the form of a part of a circular arc, the free ends of which are mutually connected such that each strip has the form of the outer surface of a truncated cone, which thus modelled strips are mutually connected with their outer circular peripheral edge; and a third part-ring consisting of a strip of sheet material which is bent into a round form and which mutually connects the free circular inner edges of the first two part-rings;

the end zones of the blades are connected to the third part-ring;

the ring has a diameter of more than about 1.50 m;

the number of blades amounts to at least eight; and the blades are hollow and comprise a framework structure which is provided with a skin connected thereto.

In a specific embodiment the fan has the special feature that the drive means comprise a centrally disposed motor which drives the hub.

Alternatively, the drive means can also comprise a motor placed at a distance from the hub outside the airflow generated by the driven blades.

Such a fan is preferably embodied such that the drive means comprise at least one decentrally disposed motor which drives the ring.

This latter variant can advantageously be embodied such that it comprises: a number of motors distributed along the periphery, for instance in angularly equidistant arrangement.

In order to prevent vibrations occurring or becoming effective, and thereby preventing substantial noise production, the fan can have the special feature that the or each motor is elastically suspended.

Use can be made of spring means, of a rubber suspension or the like. Particularly envisaged is an embodiment in which the or each motor is urged toward the rotor ring by at least one gas spring.

A recommended practical embodiment has the special feature that the rotor is supported via the ring by wheels, of which at least one is driven by a motor.

The rotor can for instance be supported in horizontal position by a number of wheels, for instance four driven wheels at the corner points of a frame. The fan can thus have the special feature that the frame has a substantially square form and the corners left clear by the round ring of the fan are provided with four respective drive motors. This variant is important for instance in the case where the frame is connected to a heat exchanger corresponding with the form of the frame, for instance a square fin-tube heat exchanger.

Alternatively, the rotor can also be supported for instance vertically (or in any other desired position) by two sets of two wheels on the underside which engage roughly perpendicularly on the conical surfaces of the rotor ring. Free-turning wheels can for instance be provided on the top side.

In the case of a horizontal position of the rotor it is not necessary to make use of counter-wheels on the other side relative to the driven wheels. Only the driven wheels determine in this case the plane of the horizontal position. There is therefore only a stable support. Surprisingly, this is a completely safe and mechanically stable construction.

The number of blades can in principle be freely chosen. Envisaged is a number in the order of eight to forty.

According to yet another aspect of the invention, the fan has the special feature that the output shaft of the motor bears a wheel with a toothing which co-acts in force-transmitting manner with a corresponding toothing on an outer surface of the ring.

A very important practical embodiment of this basic principle lies in the fan having the special feature that the toothings are embodied as plastically twisted metal strips, and both have the same pitch.

This latter variant can advantageously have the special feature that the wheel has a conicity corresponding to the conicity of the ring and its central axis extends in axial or in radial direction relative to the rotor.

As alternative to this latter aspect, the fan can have the feature that the wheel is substantially cylindrical, and its rotation axis extends parallel to a describing line of the relevant conical surface of the ring.

With a view to damping vibrations in respect of a desirable low sound emission, the fan according to the invention can have the special feature that the contact surfaces, though not the toothings, of the wheel and the ring are covered with an elastic, vibration-damping material.

Diverse materials are suitable for this purpose. Highly suitable is an embodiment in which the material comprises polyurethane.

The use of two twisted ribbons for the driving has the advantage that there is substantially line contact and only negligible friction. It will be apparent that this makes the wear-resistance of the drive very high.

The relatively small drive wheel has a relatively high rotation speed, whereby the drive contact pressure can be low. The support pressure of the rotor and the air reaction force during operation in the case of an upward airflow through the fan together form the downward directed force exerted by the fan on the supporting wheels.

According to yet another aspect of the invention, the fan has the special feature that the part-rings consist of mutually coupled segments.

With a view to the sought-after low noise production, an embodiment is important in which the segments of the part-rings have mutually differing lengths, and therefore have an aperiodic arrangement.

The fan comprises many elements which can be excited by vibrations in eigenfrequencies, and thus generate sound. Many vibration sources can be excited at their eigenfrequencies. There is a further excitation by the mains frequency of 50 Hz and the rotation speed of the rotor, multiplied by the number of blades, is a basic frequency at which components could be excited. It will be apparent that the design of the fan must be such that the eigenfrequencies must always lie a sufficiently great distance from the frequencies of these basic vibration sources.

Following these three mechanical vibration sources, there will be further discussion below of the two aerodynamic dissipation phenomena such as vortices and turbulence which can also contribute towards sound emission, albeit not specifically concentrated in determined frequencies but usually in broadband signals of quite a wide spectrum, for instance noise-like sounds.

The embodiment in which the segments of the part-rings have mutually differing lengths and therefore have an aperiodic arrangement has the advantage that due to the aperiodic arrangement a more or less irregular excitation will occur in the frequency range, whereby the frequency corresponding to the product of rotation speed and the number of transitions will not be present, or at least considerably less pronouncedly so.

It is important according to the invention that the assembly of the diverse component parts can take place very easily. In this respect the fan according to the invention can have the special feature that the connections between at least a number of component sheet metal parts of the ring are mutually connected by means of fingers which form part of the sheet metal parts and which are inserted through spaces present in co-acting parts, for instance the spaces between these parts and fingers protruding therefrom. After thus realizing the connection, the component parts can be definitively connected to each other, for instance by spot welds or other suitable definitive connections.

Substantial stiffening with negligible increase in weight is realized with an embodiment in which the ring is stiffened internally by triangular plates.

Stiffness is enhanced still further with an embodiment in which the cavity defined by the ring is filled with a material which is light compared to metal, for instance a foam material such as polyurethane foam. This foam material makes hardly any contribution to an increase in weight, but can ensure that the stiffness increases substantially.

According to the description given above, the rotor ring consists of separate, three-dimensionally preformed elements which are fitted together in sliding and/or snapping manner. The forms are chosen such that the fit is brought about only in the case of a perfectly round form. As stated, the components can finally be connected definitively to each other by for instance spot welding.

According to yet another aspect of the invention, the fan has the special feature that the frame comprises a guide ring for aerodynamic guiding of the air flowing through the fan, which guide ring has a smoothly curved active surface which is coaxial with the rotor and has an annular recess with a form corresponding to the form of the rotor ring, this recess accommodating this rotor ring with some free clearance.

Using such a guide ring the flow profile of the air through the fan can be influenced in exceptionally favourable manner, whereby the aerodynamic efficiency is greatly improved, turbulences and vortices are prevented and the sound production substantially reduced compared to the prior art.

Very important is an embodiment in which the upstream part of the active surface of the guide ring has a radial sectional form largely corresponding to a quarter of an ellipse, the longitudinal axis of which extends parallel to the central axis of the rotor.

In accordance with yet another important detail of the invention, the fan has the feature that the flow guide has a form on the downstream side such that the downstream flow through the fan is free of dead zones.

The guide ring can for instance be modelled from a blank. Use can be made of a sheet thickness in the order of 0.5-1.0 mm, with a most probable value in the order of 0.8 mm. Galvanized sheet steel or aluminium is for instance suitable as material. Alternatively, use can be made of a plastic construction, for instance consisting of polyester reinforced with glass fibre with a thickness of about 2.5-3 mm.

The filling on the downstream part relative to the rotor, i.e. the plenum chamber, can be embodied as for instance an annular insert plate having for instance a conical form or a radial section on each side with roughly the form of an S.

According to yet another aspect of the invention, the fan has the special feature that each blade is assembled from a framework which carries a skin on its outer side such that the blade has an aerodynamic form. The skin can for instance consist of metal.

This latter embodiment can have the special feature that the skin consists of steel with a thickness of a minimum of 0.3 mm for a rotor diameter of 1.50 m, which thickness increases in rough proportion to the diameter.

It is generally important that the skin has a high tensile strength.

In yet another embodiment the fan has the special feature that the skin is embodied as a pre-modellable fabric with fibre reinforcement, for instance glass fabric.

Alternatively, the fan can have the feature that the skin is embodied as an optionally pre-impregnated non-woven.

Very attractive from a production engineering viewpoint is an embodiment in which the skin is impregnated with a two-component material of the type which cures within about 45 minutes, preferably 30 minutes, such as polyester, an epoxy or the like.

In accordance with yet another choice, the fan has the special feature that the skin consists substantially of aluminium.

Yet another choice lies in the skin consisting of aluminized polyester fabric.

A further choice lies in the skin consisting of steel, in particular stainless steel or spring steel.

Simple to manufacture in practice is a fan of the described type in which the skin is manufactured by folding sheet steel along a fold line which becomes the front edge of the blade in a blade to be manufactured, after which the sheet material is modelled by elastic and optionally also plastic deformation.

An embodiment is further of importance in which the skin is connected internally to the framework by a process from the group to which belong: welding, glueing, soldering, with negligible effect on the aerodynamic smoothness of the outer surface.

According to yet another aspect of the invention, the fan comprises a stationary substantially rotation-symmetrical nose cone which is disposed fixedly relative to the frame and which is disposed upstream relative to the hub and has an outer surface which widens from its front side to its rear side and which connects at its rear side to the hub in aerodynamically smooth manner.

Such a fan is preferably embodied such that the longitudinal section of the outer surface has more or less the form of a parabola, the extreme of which is situated at the upstream end of the nose cone.

Simple, light and inexpensive to manufacture is an embodiment in which the nose cone is formed from a blank of sheet material. The nose cone can thus consist for instance of a number of sheet-like elements or facets mutually connected over a small wide zone.

In a determined embodiment the fan has the special feature that the nose cone is supported by the frame via spokes. The number of spokes is preferably kept as small as possible so as to influence the airflow as little as possible.

In the same respect use is preferably made of a variant in which the spokes are formed aerodynamically.

For safety reasons the fan can advantageously have the special feature that the fan is provided on its inlet side with a protective grill.

This latter variant can have the special feature that the protective grill carries the nose cone.

It is generally important that the component metal parts are manufactured with great precision using a simple process. In this respect the fan can have the special feature that at least a number of metal parts are formed by laser cutting.

The fan can also have the special feature that the form of the guide ring and the blades is also chosen on the basis of the ground effect, i.e. the throughflow distance between the entry plane of the flow guide and a surface, such as a wall or the ground, placed at a distance parallel thereto, in addition to optionally the flow resistance of a device, such as a heat exchanger, disposed downstream of the fan.

It is noted that with the described driving the relevant pressure forces can remain very limited when use is made of a number of motors, for instance four. This greatly enhances the wear-resistance and thereby the lifespan of the fan.

Owing to the high aerodynamic efficiency of the fan according to the invention only a relatively low tip speed is necessary, whereby the sound production remains limited. Very substantial decreases in sound emission can be realized compared to the prior art. Improvements in the order of 15 dB can be realized. Alternatively, a higher performance can be realized with the same sound production as in a prior art fan.

It is important according to the invention to be able to cater for performance variability in flow rate and pressure losses in the flow path. The angle of attack in very large fans as in the invention, for instance with a diameter in the order of 1.5-15 m, is conventionally made variable so as to find the best possible setting in practice at a chosen peripheral speed of the blade tips. The limitation here is the permissible sound level generated. The fixed profile form of the fan according to the invention is designed to cater for this with variable rotation speed, also with feedback, with a wide headroom to the maximum realizable thrust. The conventional blade shapes are, for economic reasons, often already at this maximum.

It will be apparent from the foregoing that a rotor, owing to its substantially hollow construction, can be very light compared to the solid prior art rotors. Envisaged is a weight of a rotor in the order of 10% of the weight of a known rotor.

A rotor consists of few parts. These can be assembled from groups of identical components.

Modelling can take place by sawing, punching, severing, cutting, in particular laser cutting.

The fan according to the invention can find application for instance in large heat exchangers, for instance for air-cooled cooling devices, ventilation purposes, extraction, air-conditioning in large buildings or other enclosed spaces, wind tunnels and the like.

In the case of an appropriate design, the fan according to the invention is readily suitable for retrofitting, wherein with a relatively simple intervention an existing fan can be replaced by a fan according to the invention.

The invention will now be elucidated on the basis of the accompanying drawings, in which a number of exemplary embodiments and aspects of the invention are shown, to which the invention is not however limited.

BRIEF DESCRIPTION OF THE DRAWINGS

FIGS. 1*b*-1, 1*b*-2 and 1*b*-3 show three views corresponding to FIG. 1*a* of a variant according to the prior art;

FIGS. 1*c*-1, 1*c*-2 and 1*c*-3 show three views corresponding with FIGS. 1*a* and 1*b* of a variant with four fans according to the prior art;

FIGS. 1*d*-1, 1*d*-2 and 1*d*-3 show three views corresponding with FIGS. 1*a*, 1*b*, 1*c* of a variant with eight fans according to the prior art;

FIG. 3 shows a schematic view of the framework forming the inner side of a blade;

FIG. 9 shows an overview of the design parameters for the radial sectional form of the flow guide shown in FIG. 8;

FIG. 10 is a schematic view of an axial section through a fan with a flow guide according to the invention showing schematically with arrows the air speed profile at a downstream distance from the fan;

FIGS. 12*a*-1, 12*a*-2, 12*a*-3, 12*a*-4 and 12*a*-5 show blanks consisting of metal strips which can be coupled to each other and, in coupled state, can be converted to form the outer surface of a truncated cone;

FIGS. 13*a*-1, 13*a*-2, 13*a*-3 and 13*a*-4 show a blank for manufacturing a rotor hub;

DETAILED DESCRIPTION OF THE PREFERRED EMBODIMENTS

Figures 1, 1A:
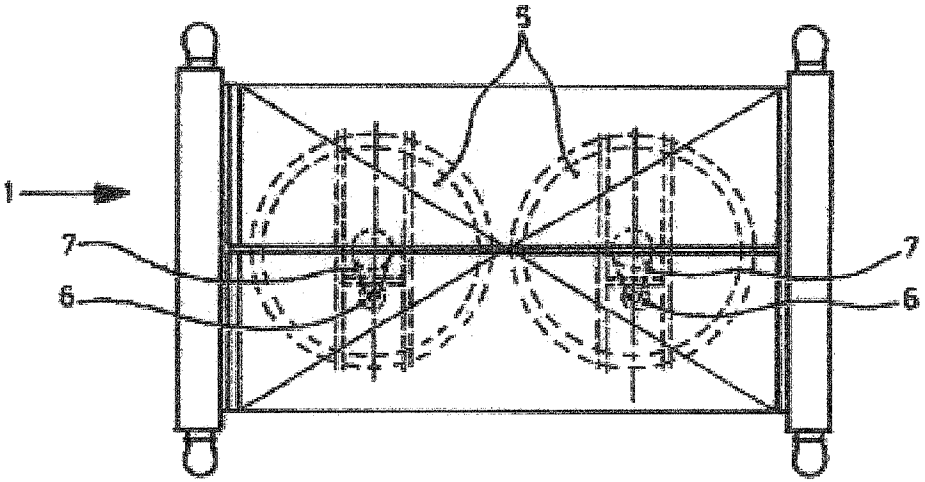
fig. 1a-1 PRIOR ART
FIGS. 1*a*-1, 1*a*-2 and 1*a*-3 show three mutually perpendicular representative views of a known heat exchanger with two fans according to the prior art.

FIGS. 1*a*, 1*b*, 1*c* and 1*d* show traditional arrangements, wherein a fan consists of a rotatably disposed hub which is driven by motor means and carries a number of fan blades. All fans are disposed horizontally in these embodiments and blow air supplied from the underside along the ground upward through a heat exchanger.

FIGS. 1*a*-1, 1*b*-1, 1*c*-1 and 1*d*-1 show top views and the other figures perpendicular side views. The relevant fan units are designated with the reference numerals 1, 2, 3 and 4. Fans 5 are driven by motors via drive belts 7.

Figure 2A:
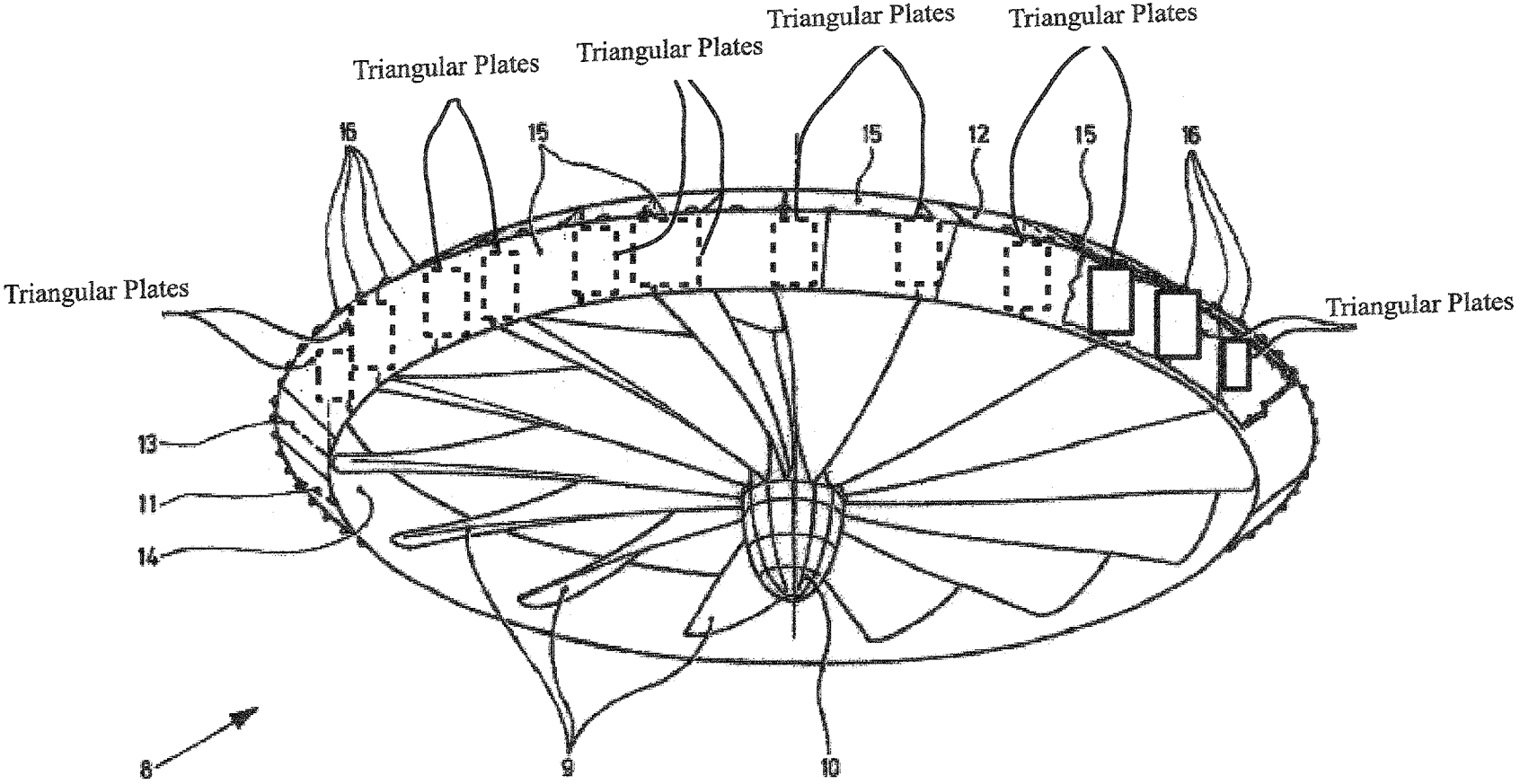
FIG. 2*a* shows a bottom view of a rotor with a nose cone according to the invention.

FIG. 2*a* shows the basic form of a rotor 8 according to the invention. This comprises a number of aerodynamically formed rotor blades 9, a central hub 10 and a ring 11 mutually connecting the ends of rotor blades 9. Ring 11 is constructed from three part-rings 12, 13, 14 which are in turn built up of part-ring segments, which are all designated for the sake of convenience with reference numeral 15. The outer part-rings 12, 13 are coupled to each other in zones 16. The ring 11 comprises a plurality of internal triangular reinforcement plates 101.

Figures 2B, 2C:
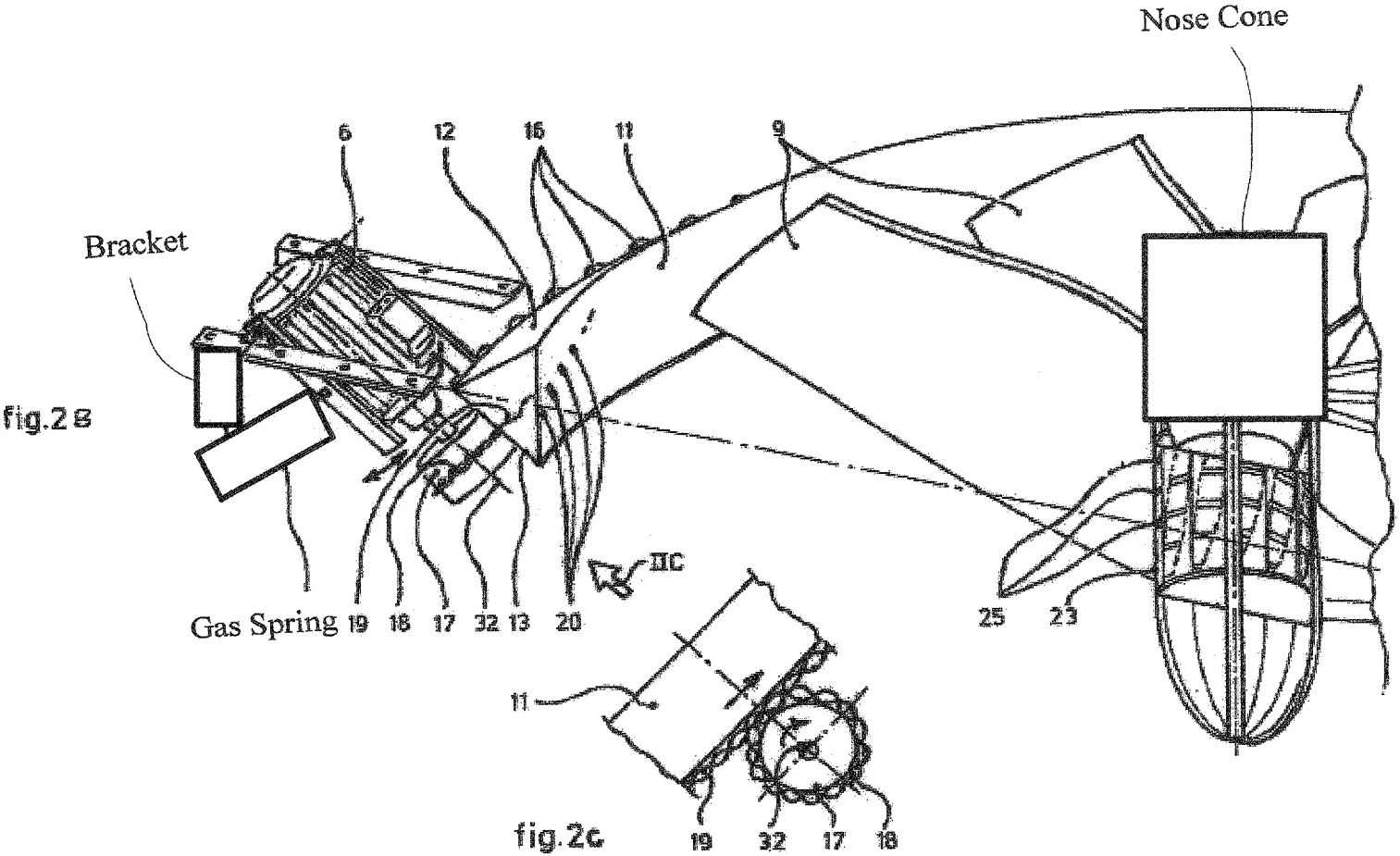
FIG. 2*b* shows a view on larger scale in partially cut-away perspective of a part of the rotor ring with drive, wherein a number of blades and the hub as well as the inlet cone are also shown.
FIG. 2*c* shows the detail IIc of FIG. 2*b*.
Figure 3:
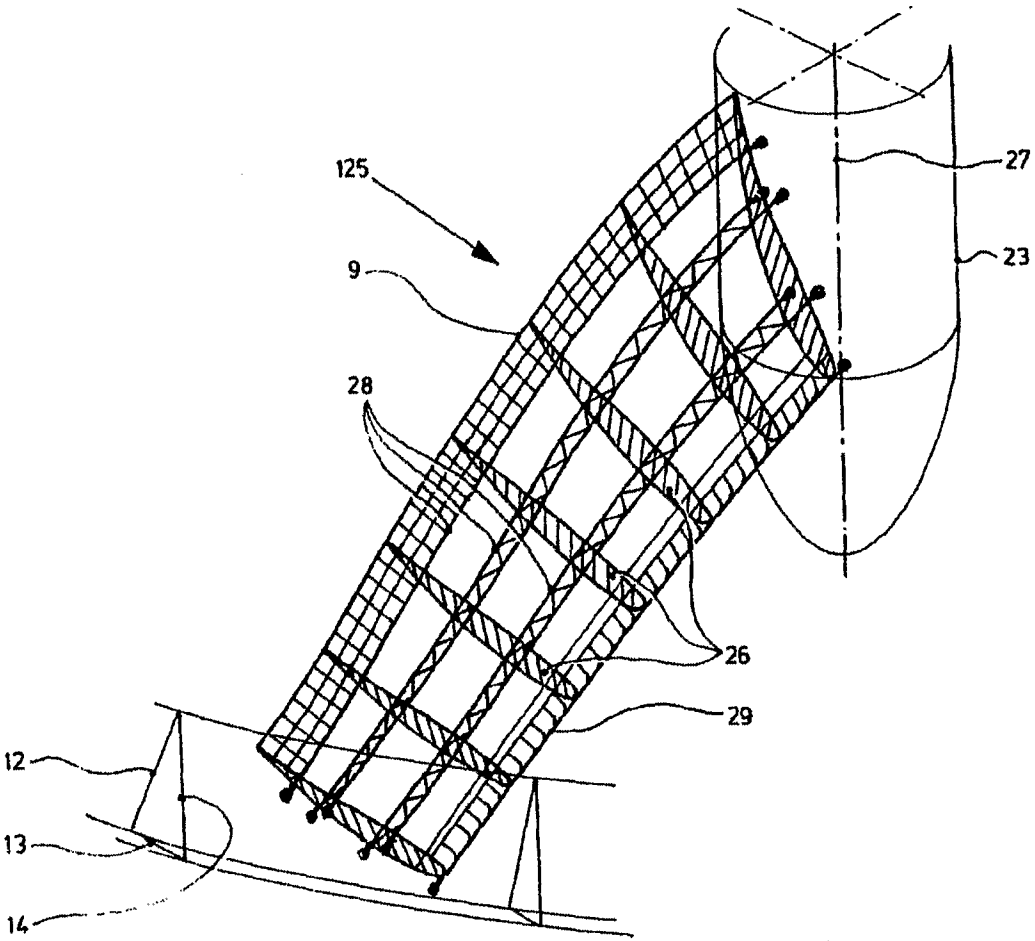

FIG. 2*b* shows that ring 11 of the rotor to which the end zones of blades 9 are connected has a generally triangular cross-section. An electric motor 6 drives a drive wheel 17 which has a toothing 18 which co-acts with a toothing 19 present on rotor ring 11 (shown in FIG. 2*c* ). The electric motor 6 is elastically suspended and is urged toward rotor ring 11 by a gas spring 102. The inner,generally cylindrical part-ring 14 extending in axial direction has groups of perforations 20 which serve for passage of tongues 21 on the end zones of the skin plates of blades 9. Reference is made in this respect to the blank 22 of FIG. 14, which shows that the blank has tongues 21 on its outer side to be directed toward ring 11 and functionally corresponding tongues 24 on its inner zone to be directed toward hub 23 (see FIG. 2*b*).

FIG. 2*b* further shows that, by means of tongues 21 inserted into perforations 25 in hub 23, the blades 9 are connected thereto by folding down these tongues 21 in the same manner as tongues 21 secure the coupling to part-ring 14 via perforations 20.

FIG 2*c* shows that the teething 18 and 19 are embobied as plastically twisted metal strips and both have the same pitch.

Figures 1, 1A, 2, 3:
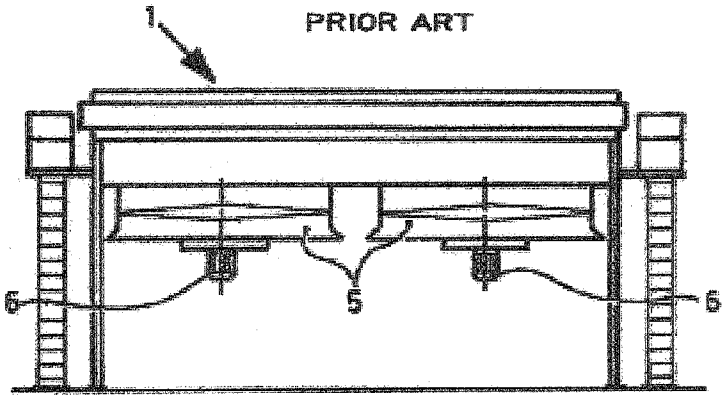
fig.1a-3 PRIOR ART
Figures 1, 1A, 2:
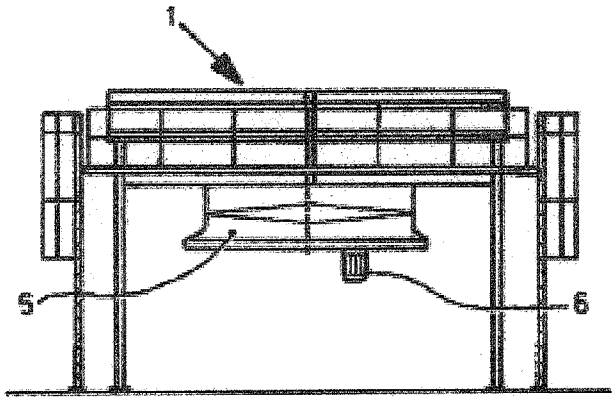
fig.1a-2 PRIOR ART
Figures 1, 1B:
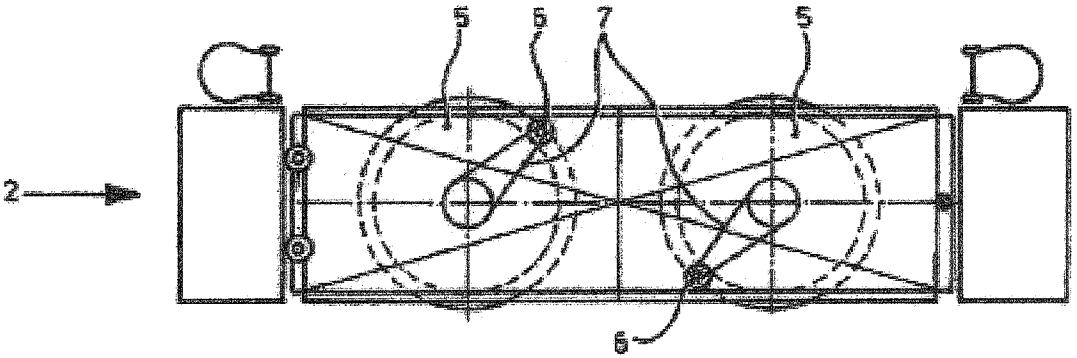
fig.1b-1 PRIOR ART
Figures 1, 1B, 2, 3:
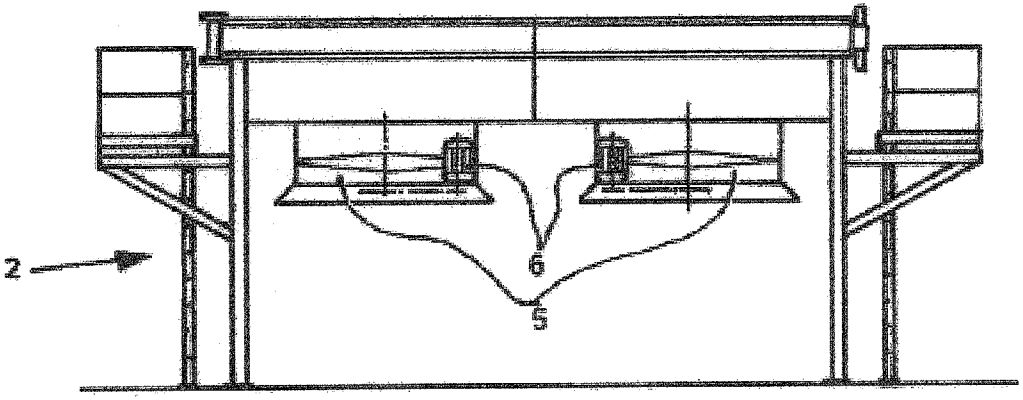
fig.1b-3 PRIOR ART
Figures 1, 1B, 2:
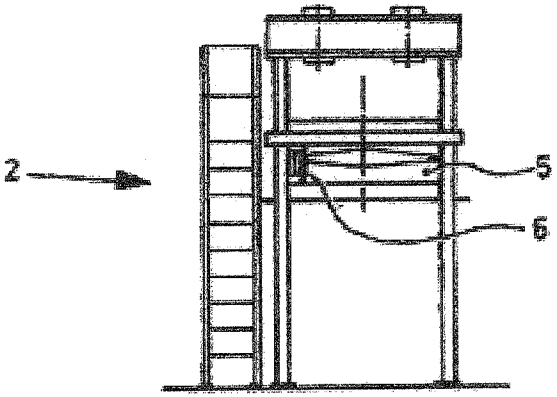
fig.1b-2 PRIOR ART
Figures 1, 1C:
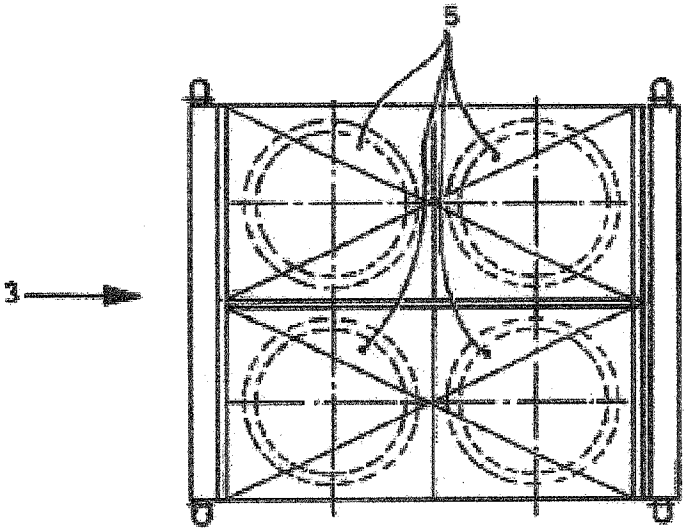
fig.1c-1 PRIOR ART
Figures 1, 1C, 2, 3:
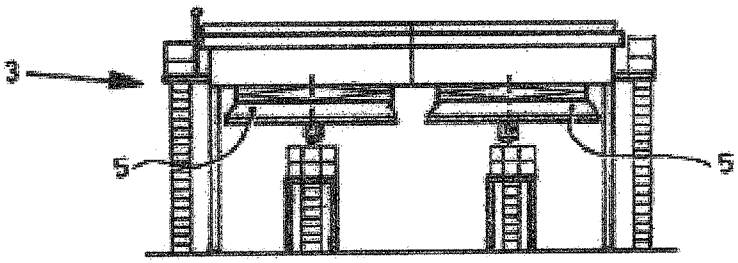
fig.1c-3 PRIOR ART
Figures 1, 1C, 2:
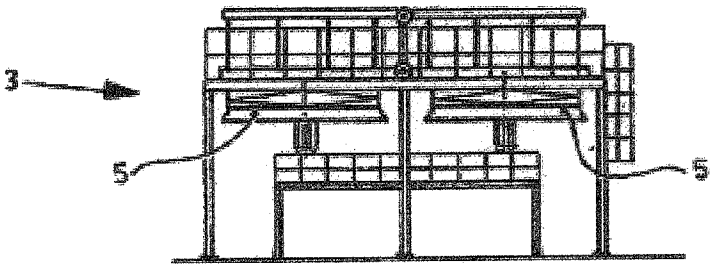
fig.1c-2 PRIOR ART
Figures 1, 1D:
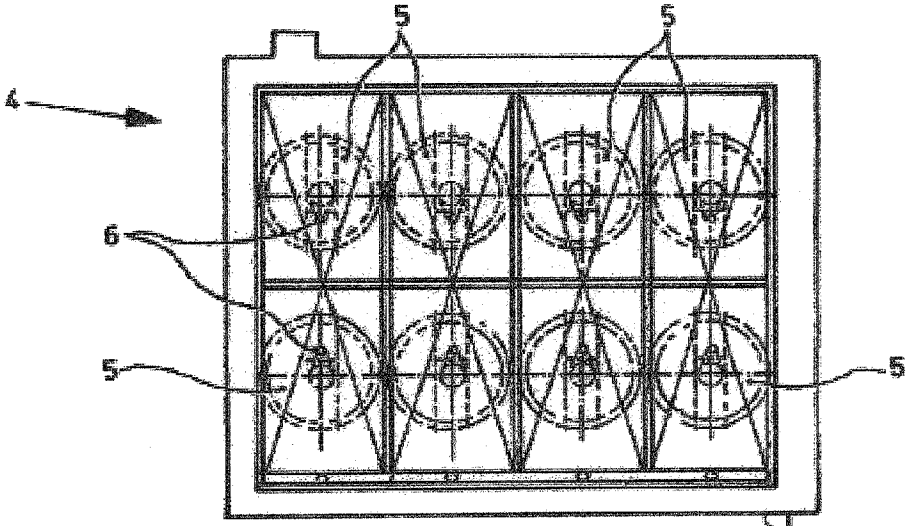
fig.1d-1 PRIOR ART
Figures 1, 1D, 2, 3:
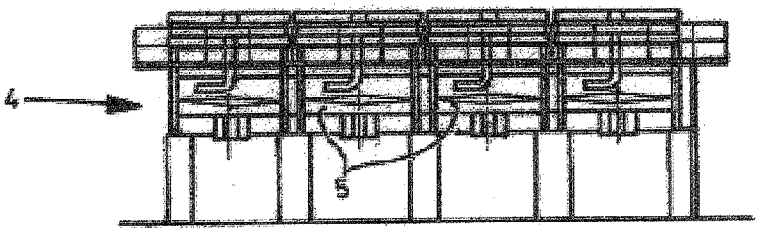
fig.1d-3 PRIOR ART
Figures 1, 1D, 2:
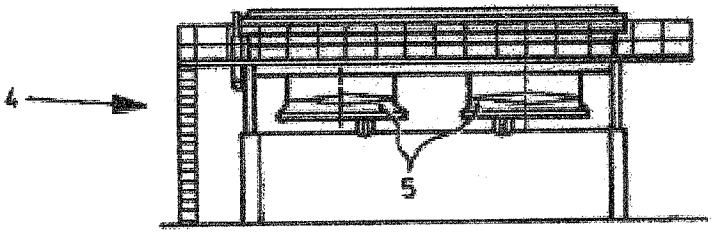
fig.1d-2 PRIOR ART

FIG. 3 shows schematically the form of the framework 25 on the basis of which a blade 9 is formed. The framework 25 comprises aerodynamically formed shaping elements, which are all designated with reference numeral 26 but have a form and position which depends on their respective radial position relative to central axis 27. Positioning rods 28 are connected on one side to part-ring 14 and on the other side to the outer wall of hub 23. As shown in FIG. 3, these elongate positioning rods 28 extend more or less in radial direction.

Anticipating the discussion to follow below of the method of assembling the rotor blades as according to FIG. 17, it is already noted here that the front edge 29 is straight such that the skin plates, which must be arranged over framework 25, can be placed by folding blank 22 over both main surfaces around the straight front edge 29.

Figure 4:
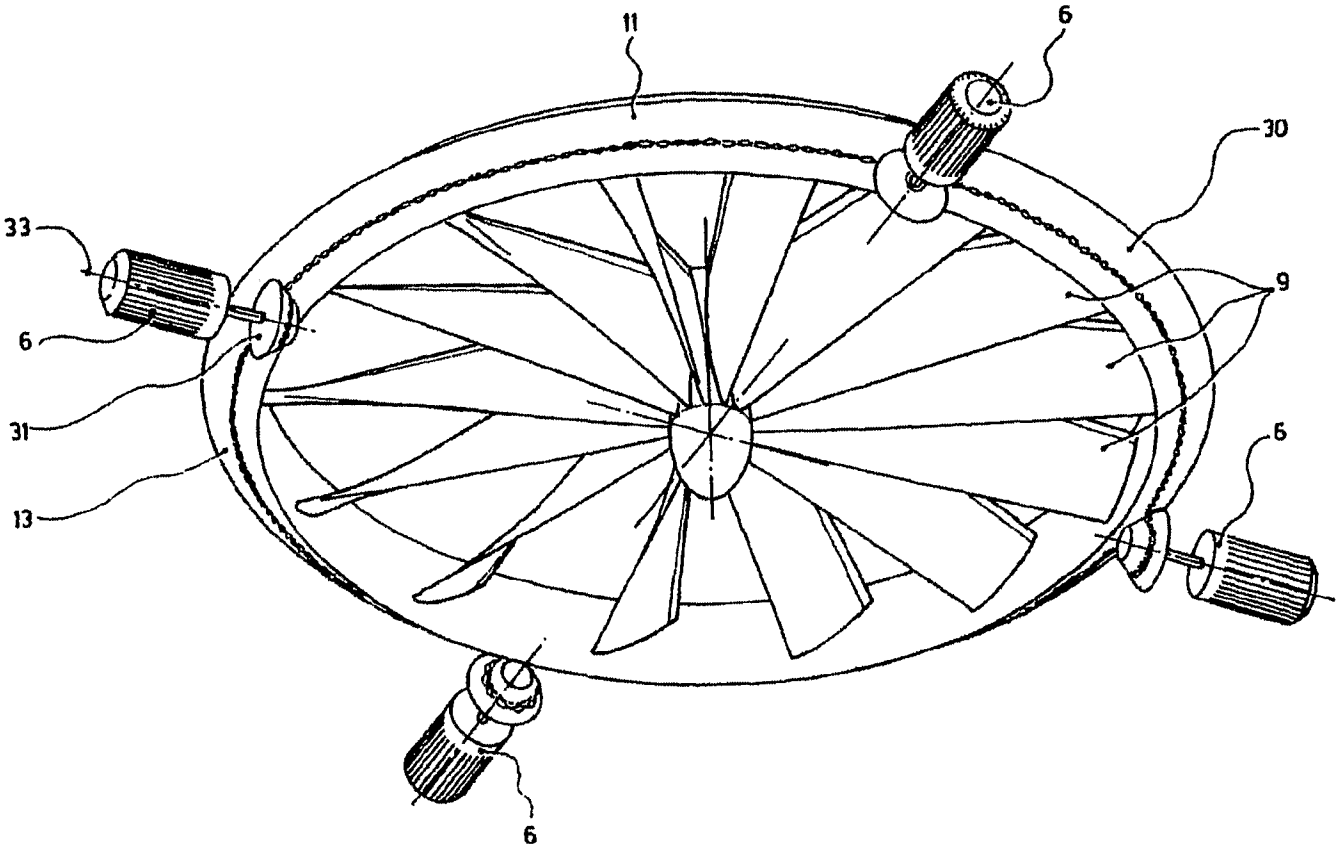
FIG. 4 is a bottom view of a rotor and four drives supporting and driving this rotor in horizontal position.

FIG. 4 shows schematically that rotor 30 is driven at four angularly equidistant positions by respective motors 6 via a truncated conical drive wheel 31. Attention is also drawn in this respect to the above discussed FIG. 2*b*, which shows a drive in which a drive wheel 17 has a substantially cylindrical form. In the situation shown in FIG. 2 the central axis 32 of drive wheel 7 locally extends parallel to part-ring 13. In the situation shown in FIG. 4 the central axis 33 is directed substantially radially. In both cases the outer surface of drive wheel 17, 31 has a position such that, if it were to come into contact with part-ring 13, it would have a tangent in common therewith.

Figure 5:
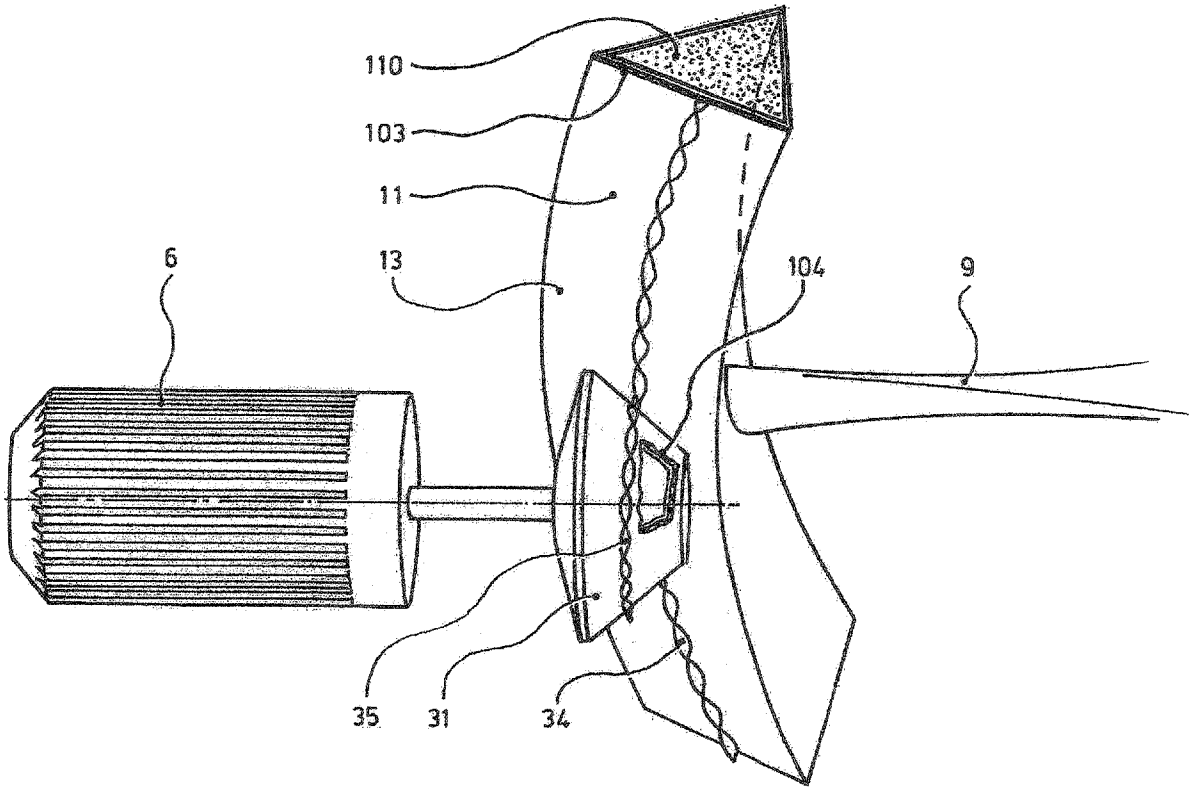
FIG. 5 shows a part of the rotor with a drive on enlarged scale, partially broken away.

FIG. 5 shows this latter in more detail. This figure also shows that part-ring 13 is provided with a twisted metal, preferably spring steel ribbon 34 which thus forms a toothing, which toothing co-acts with a correspondingly twisted ribbon 35 on each of the conical drive wheels of the respective drives. It will be apparent from the shown proportions that the four conical drive wheels 31 will have a substantially greater angular speed than rotor 30.

The outer surfaces of part-ring 13 and drive wheel 31 are provided with respective elastic, vibration-damping cover layers 103 and 104, for instance of a polyurethane. The ring 11 is filled with polyurethane foam material 110.

The longitudinal section of outer surface of nose cone 47 has a form of a parabola, the extreme of which is situated at an upstream end of the nose cone 47. Thus, the fan includes a stationary, substantially rotation-symmetrical nose cone 47 which is disposed fixedly relative to a flow guide 36 and which is disposed upstream relative to the hub 106 and has an outer surface 107 which widens from a front side 108 to a rear side 109 and which connects at the rear side 109 to the hub 106 in a aerodynamically smooth manner.

Figure 6:
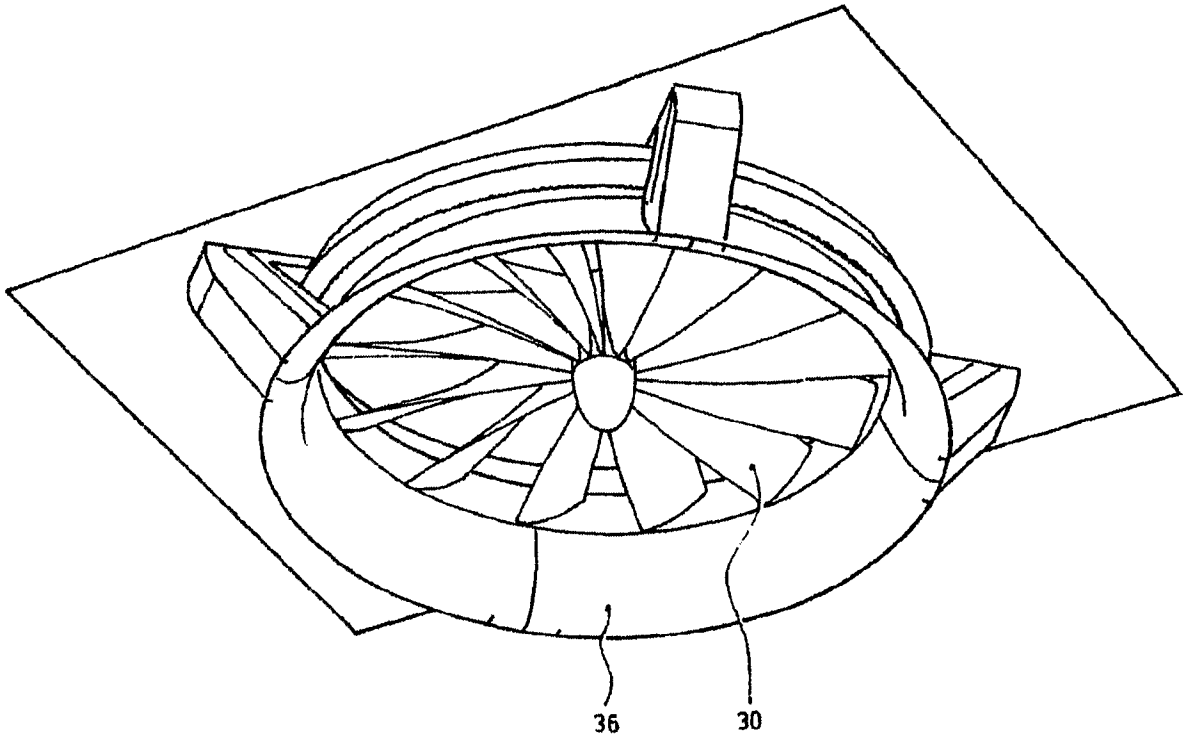
FIG. 6 is a perspective view from the underside of a horizontal fan, the rotor ring of which is driven by four drives disposed equidistantly at 90° to each other.

FIG. 6 shows a relatively primitive annular flow guide 36.

Figure 7:
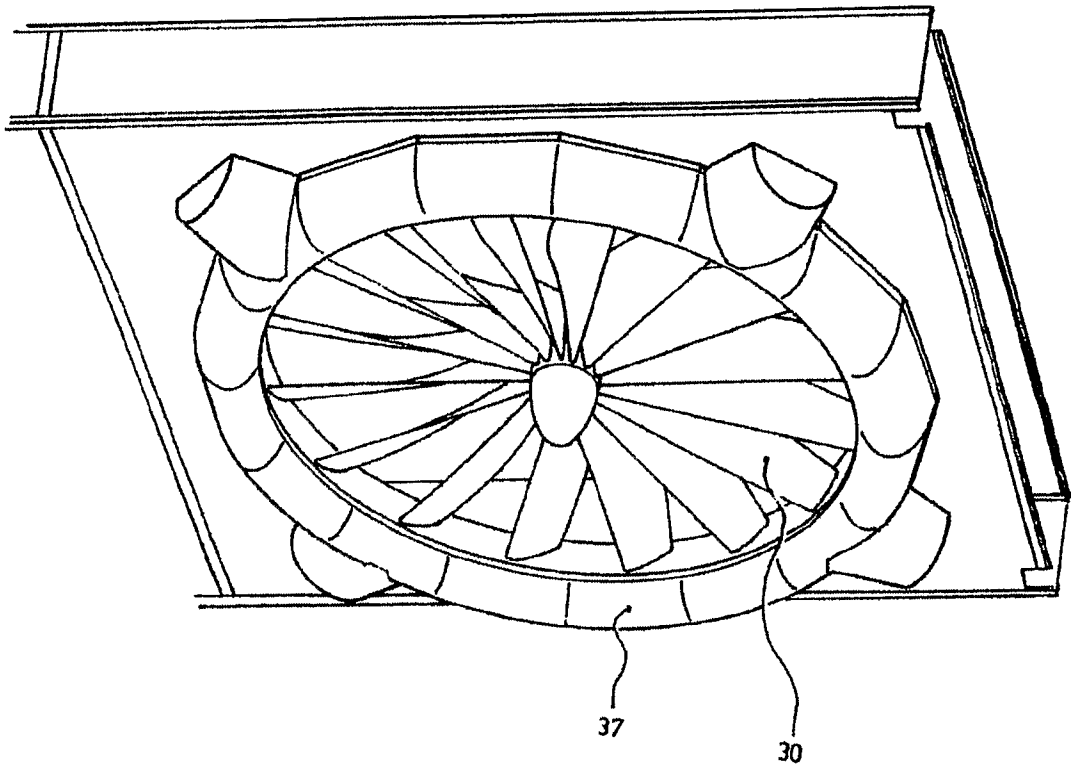
FIG. 7 is a schematic perspective view of a fan with a flow guide which is provided with spaces for accommodating four drives.

FIG. 7 shows a technically more refined flow guide 37.

Figure 8:
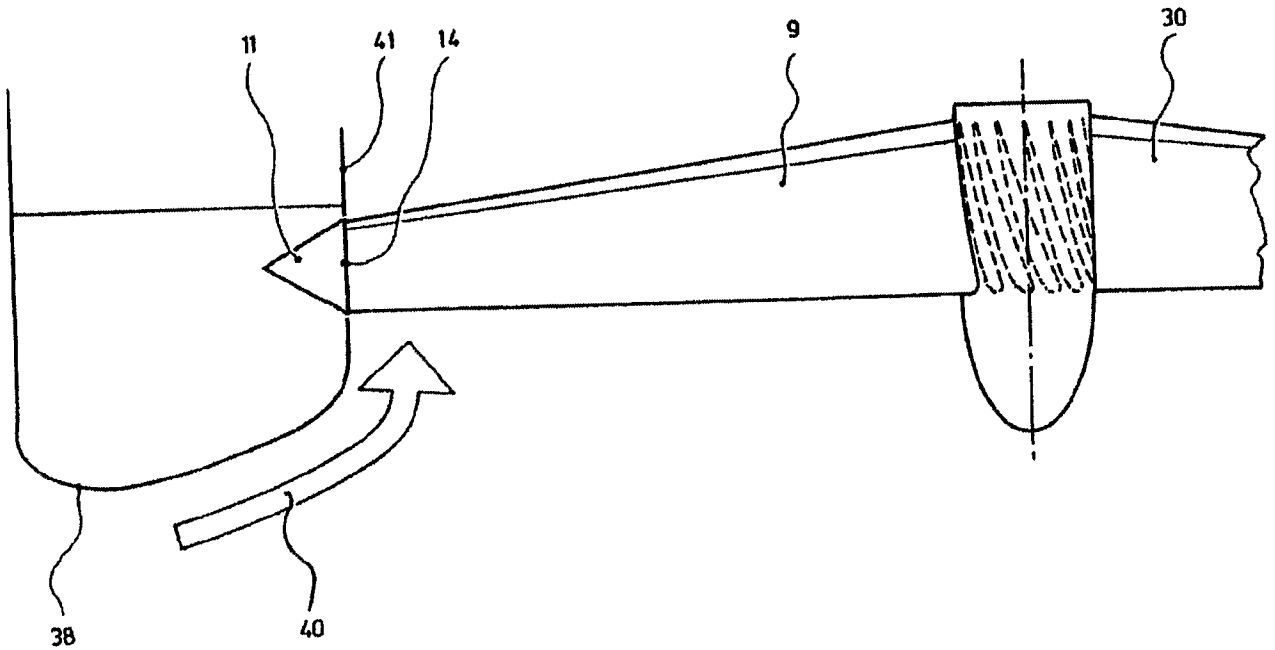
FIG. 8 shows a schematic cross-section through a fan with a flow guide.
Figure 1D:
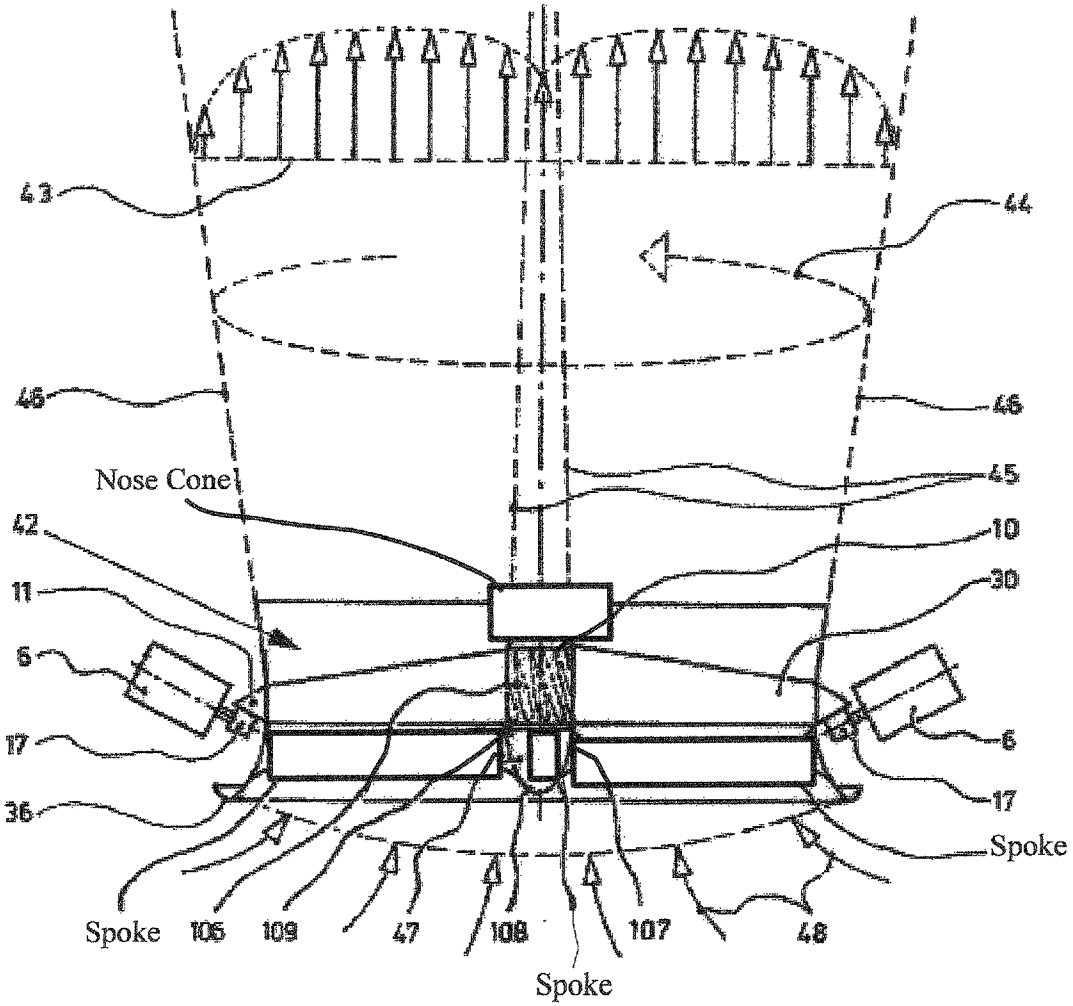

FIG. 8 shows an important practical embodiment of a flow guide.

FIG. 9 shows the manner in which the chosen profile of the flow guide can be derived from the laws of aerodynamics on the basis of chosen criteria. It is noted that such a choice of such a profile is not known from the literature and is not in the least evident, and the profile indicated with reference numeral 39 corresponds to the cross-sectional form of the flow guide 38 shown in FIG. 8. It will be apparent that this has an annular form. For the sake of completeness attention is drawn to the fact that flow guide 38 has a recess at the position of ring 11 such that the inner surface of part-ring 14 connects without notable transition to the relevant end of flow guide 38. On the downstream side (see arrow 40) which indicates the general direction of flow, the continuation of the flow guide, which is designated with 41, connects in the same manner to part-ring 14.

The chosen form ensures very gradual changes in the pressure gradient of the throughflow air.

FIG. 10 shows a fan 42 according to the invention and the speed profile 43 of the exiting airflow. For safety reasons a grill is placed on the front side.

A curved arrow 44 indicates that the airflow generated by rotor 30 has, in addition to an axial component, a rotation component as well. The broken lines 45 in the middle and 46 at the sides indicate the limits of the flow generated by rotor 30.

It is noted that in this embodiment nose cone 47 of hub 10 is not embodied integrally with hub 10, but has a stationary disposition. In that case it is connected to the fixed world, in particular to flow guide 36, by means of spokes 105.

Also shown highly schematically with arrows 48 is the direction of the inflowing air.

Figure 11:
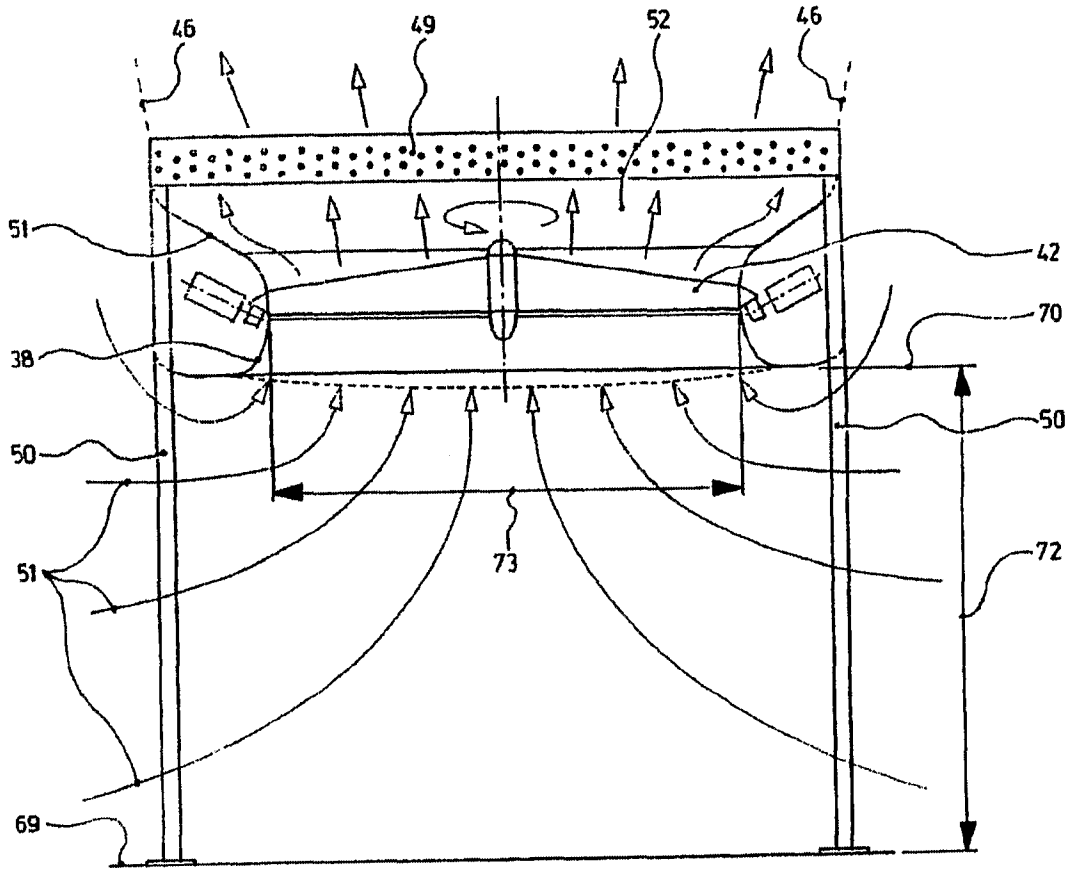
FIG. 11 shows a schematic cross-section through a fan according to the invention which co-acts with a heat exchanger placed downstream thereof.

FIG. 11 shows a cross-section of a fan 42 which, other than in FIG. 10, is provided with an advanced flow guide 38. A fin-tube heat exchanger 49 is arranged on the downstream side of fan 42. Fan 42 and heat exchanger 49 are supported by legs 50 such that the inflowing air is able to flow in laterally as according to arrows 51. The shown smooth progression is the result of the well-considered design of flow guide 38. The part of flow guide 38, designated with arrows 51, downstream of fan 42 has a form such that the known problem of dead zones and the associated vortices and turbulences in plenum chamber 52 is effectively prevented.

The free height 72 between the ground 69 and inlet surface 70 is preferably at least as great as the inner diameter 73 of flow guide 38.

Figures 2, 12A:
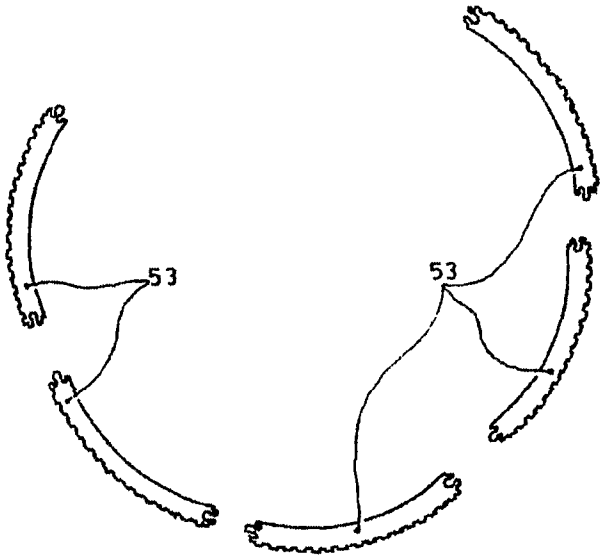
Figures 1, 12A:
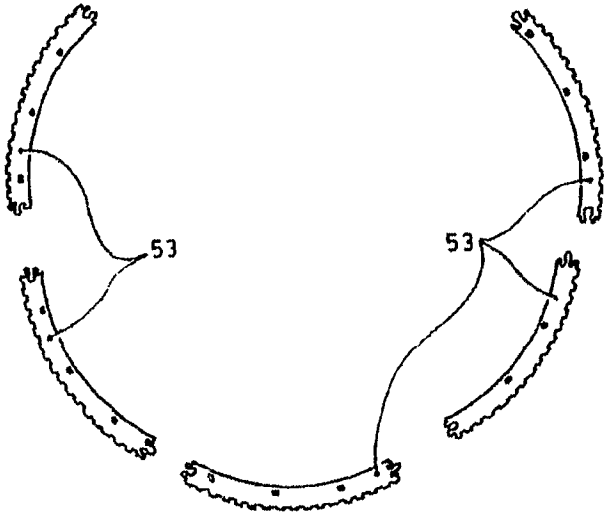
Figures 3, 12A:
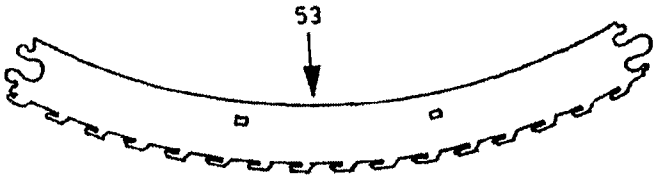
Figure 12:
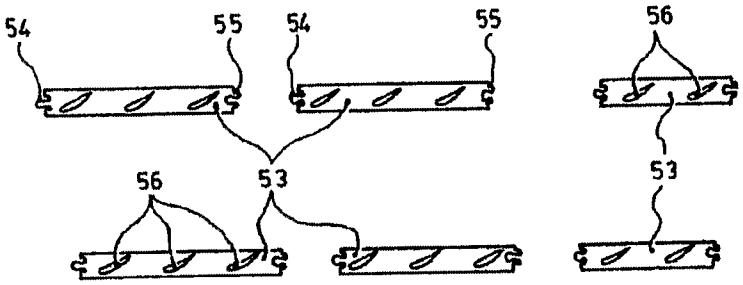
Figures 5, 12A:
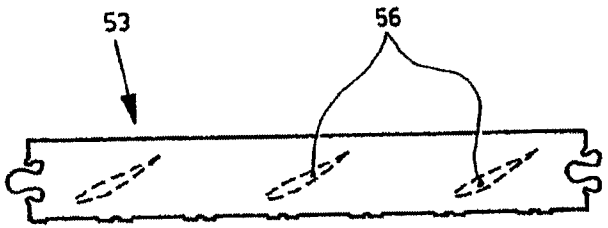
Figures 1, 13A:
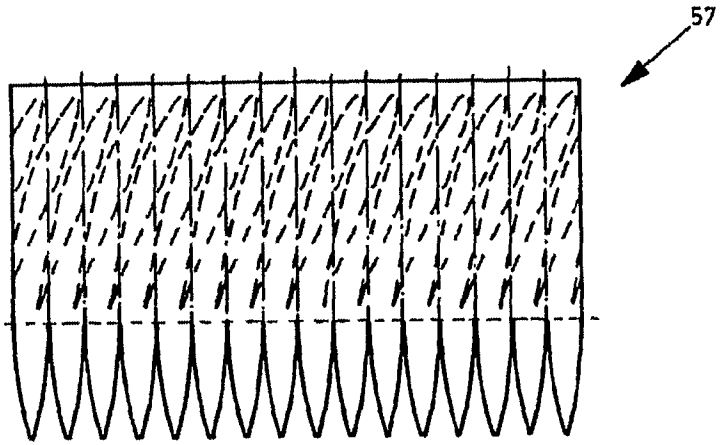
Figures 3, 13A:
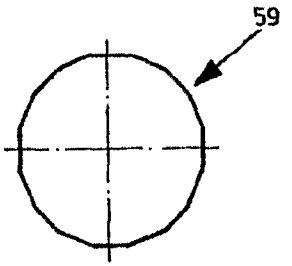
Figures 4, 13A:
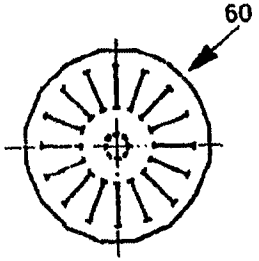
Figures 2, 13A:
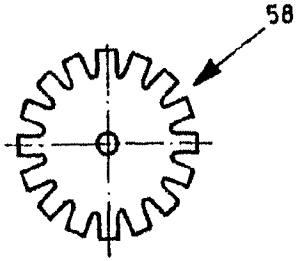

FIGS. 12*a*-1 to 12*a*-5 show the blanks for the metal strips with a thickness of about 0.8 mm from which a rotor ring can be assembled. The profiles end zones 54, 55 of the strip in question fit into each other. The protruding fingers with slots present thereunder are modelled such that slots and fingers fit exactly into each other to form an exactly round rotor ring. Part-ring 14 of rotor ring 11 is realized with a third strip, which can likewise be manufactured from for instance steel. The end zones of the blades are connected thereto as designated with 56.

It is important to note that the lengths of the different components differ from each other to at least some extent, whereby a certain aperiodicity is realized.

FIG. 13 shows blanks 57, 58, 59, 60 of sheet metal with a thickness of about 1.2 mm, on the basis of which the rotor hub can be manufactured. The associated blade forms are drawn schematically.

Figure 14:
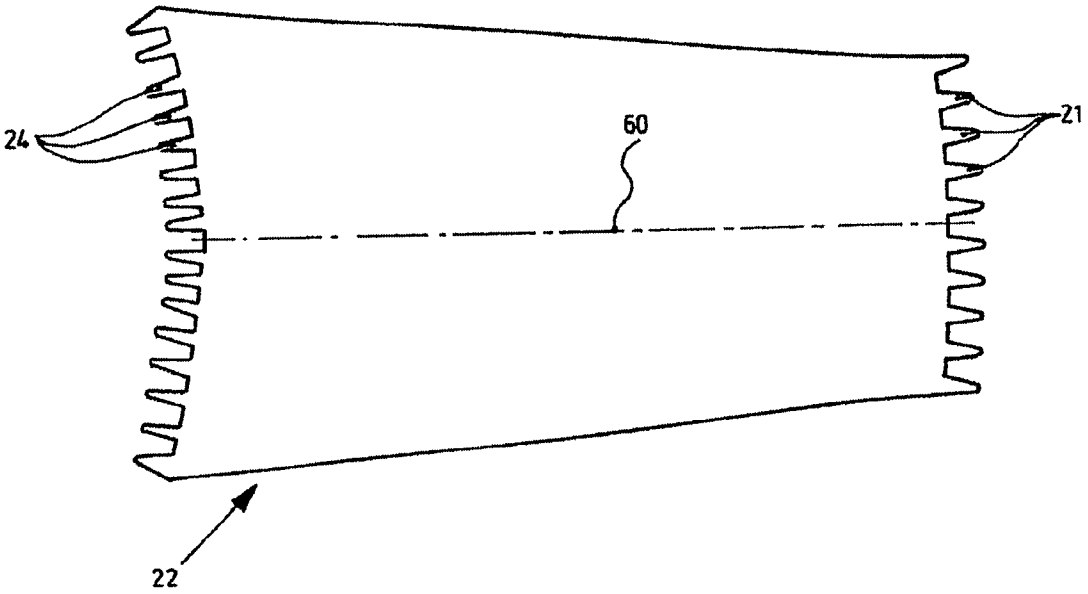
FIG. 14 shows a blank for forming the skin plates of a rotor blade.

FIG. 14 shows the skin plate blank 22 for a blade 9.

Figure 15:
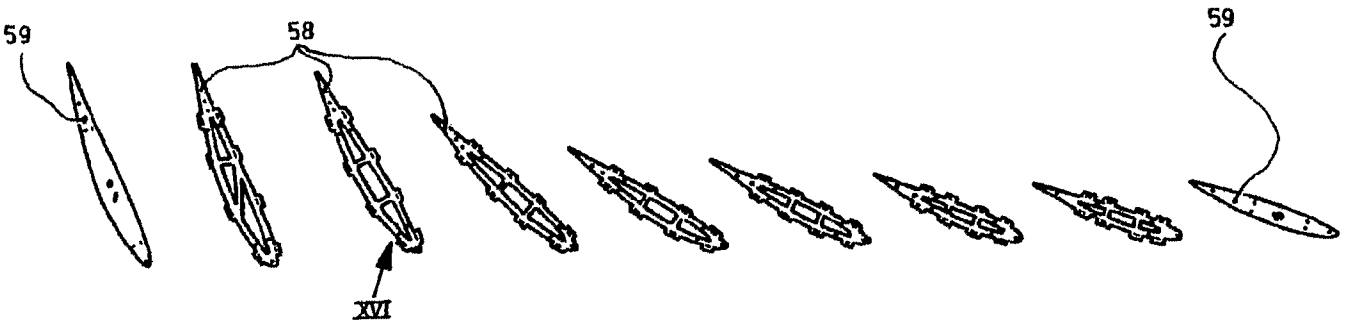
FIG. 15 shows several views for the purpose of elucidating the form and position of the framework elements inside a rotor blade.

FIG. 15 shows examples of framework elements 58 and end plates 59 for coupling to hubs 10 and rotor ring 11.

The elements have holes for hoses 28 and have a form-retaining form.

Figure 16:
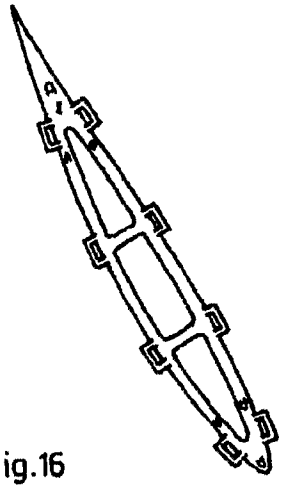
FIG. 16 shows the detail XVI of FIG. 15 on enlarged scale.
Figure 17B:
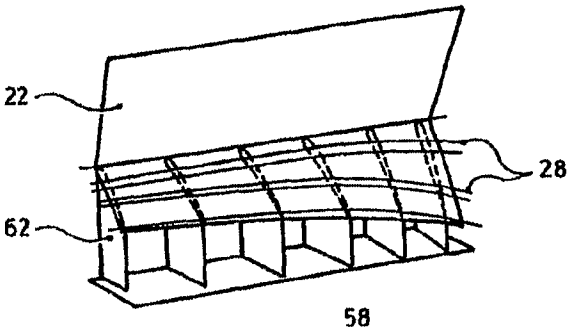
FIGS. 17*a*, 17*b*, 17*c*, 17*d* show a number of views for the purpose of elucidating the manufacture of a blade on the basis of a framework structure and a skin.
Figure 17D:
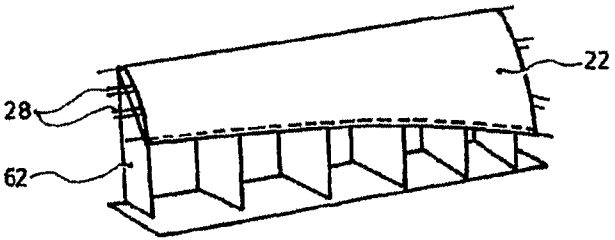
Figure 17A:
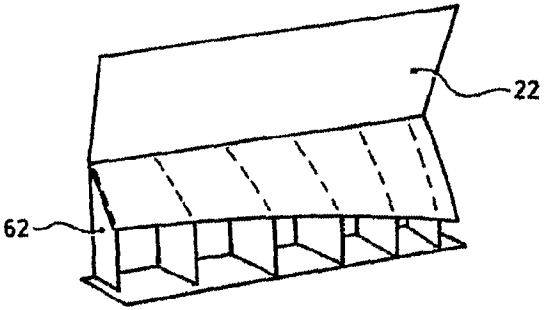
Figure 17C:
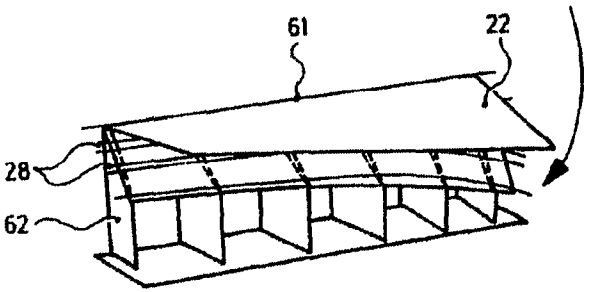
Figure 18:
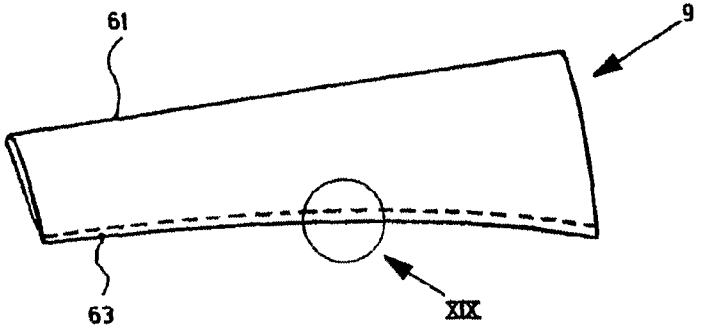
FIG. 18 shows a part of a rotor blade 9 with a round front edge 61 and a sharp rear edge 63 formed by folding a blank as according to FIG. 14.
Figure 19:
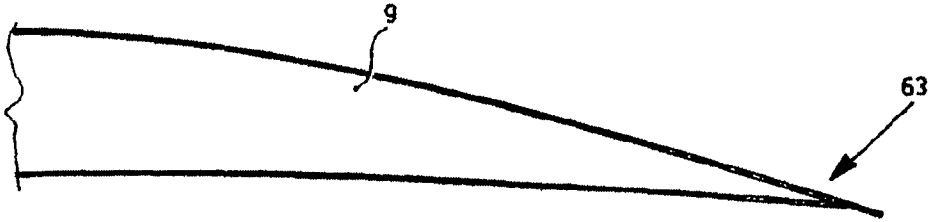
FIG. 19 shows the detail XIX of FIG. 18, from which it is apparent that the rear edge 63 can be made sharper by arranging a thin strong adhesive layer over the upper surface and the lower surface of blade 9.

FIG. 16 shows detail XVI of FIG. 15 on enlarged scale.

FIG. 17 shows the manner in which a blade can be placed on a pre-manufactured mould 62, is bent back over a straight fold line 61, arranged over a meanwhile placed framework 26, 28, connected to this framework and finally finished.

FIGS. 20*a*-*h* show schematically the manner in which a rotor 8 can be manufactured in steps.

Figure 20B:
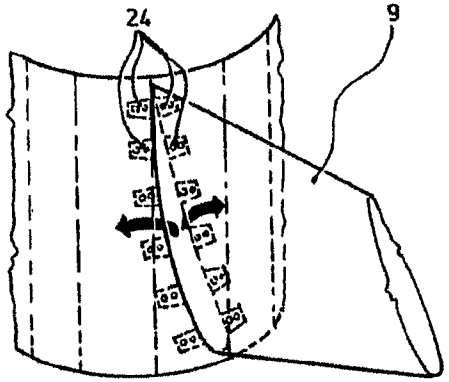
FIGS. 20*a*, 20*b*, 20*c*, 20*d*, 20*e*, 20*f*, 20*g* and 20*h* show a number of schematic views for the purpose of elucidating the method of assembling a rotor.
Figure 20D:
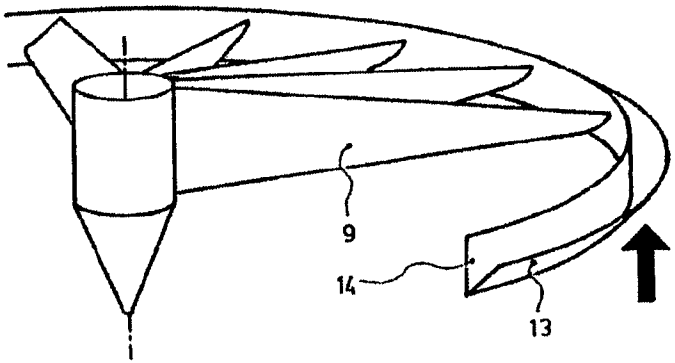
Figure 20A:
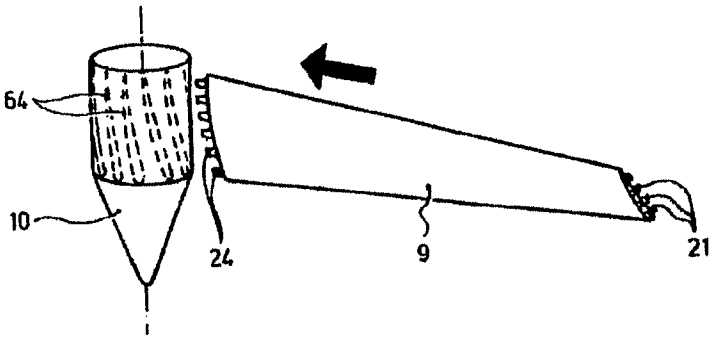

FIG. 20*a* shows that tongues 24 are inserted in corresponding patterns 64 of perforations in hub 10.

FIG. 20*b* shows that tongues 24 are bent back and connected by spot welding to the hub. Where appropriate, this technique is used at all times in the assembly of components of the fan according to the invention.

Figure 20C:
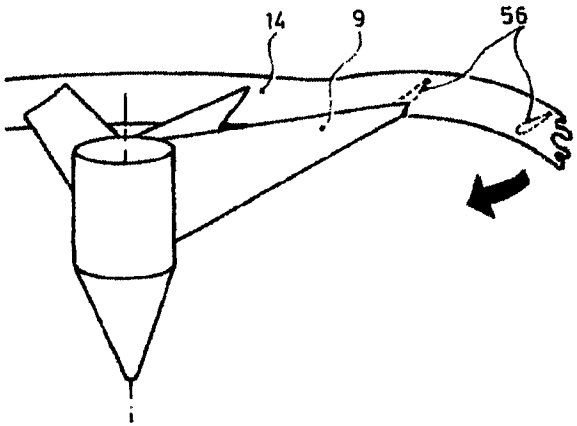

FIG. 20*c* shows that tongues 21 are inserted into the patterns 56 of perforations of part-ring 14.

FIG. 20*d* shows that part-ring 13 is then connected to part-ring 14.

Figure 20F:
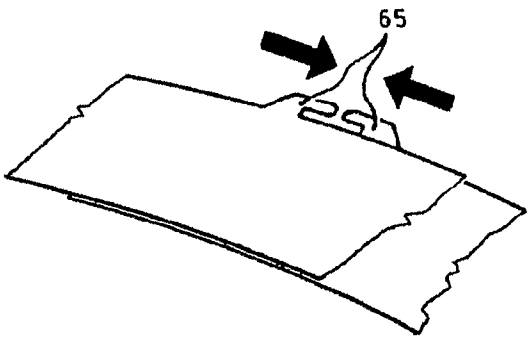
Figure 20H:
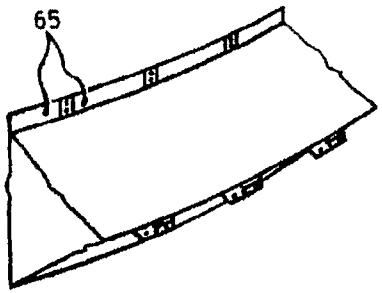
Figure 20E:
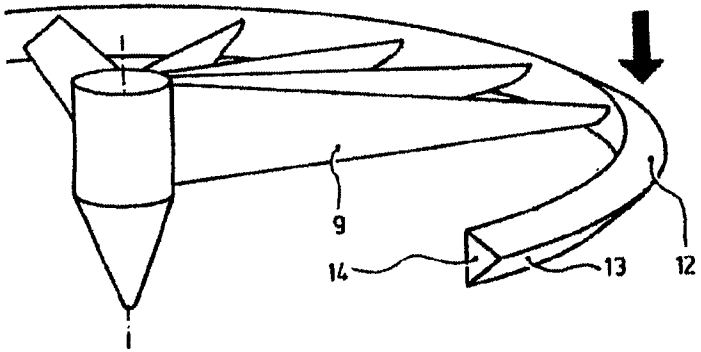

FIG. 20*e* shows that part-ring 12 is then connected to part-rings 14 and 13.

Figure 20G:
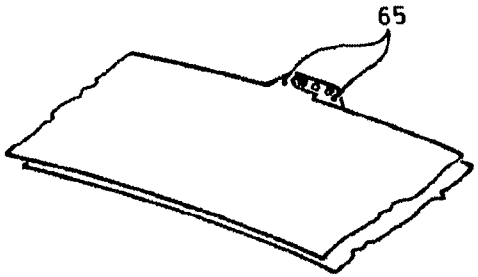

FIG. 20*f* shows the manner in which part-rings 12, 13, 14 are mutually coupled, i.e. by making use of the complementary tongues 65 slidable over each other such that the coupling is created as according to FIG. 20*g*, in which tongues 56 are finally connected to each other by spot welding.

FIG. 20*h* shows the finally obtained three-dimensional structure displaying a high degree of lightness and stiffness.

FIGS. 21*a*, 21*b*, 21*c*, 21*d*, 21*e* show schematically the successive stages of the construction of a fan on a frame.

Figure 21A:
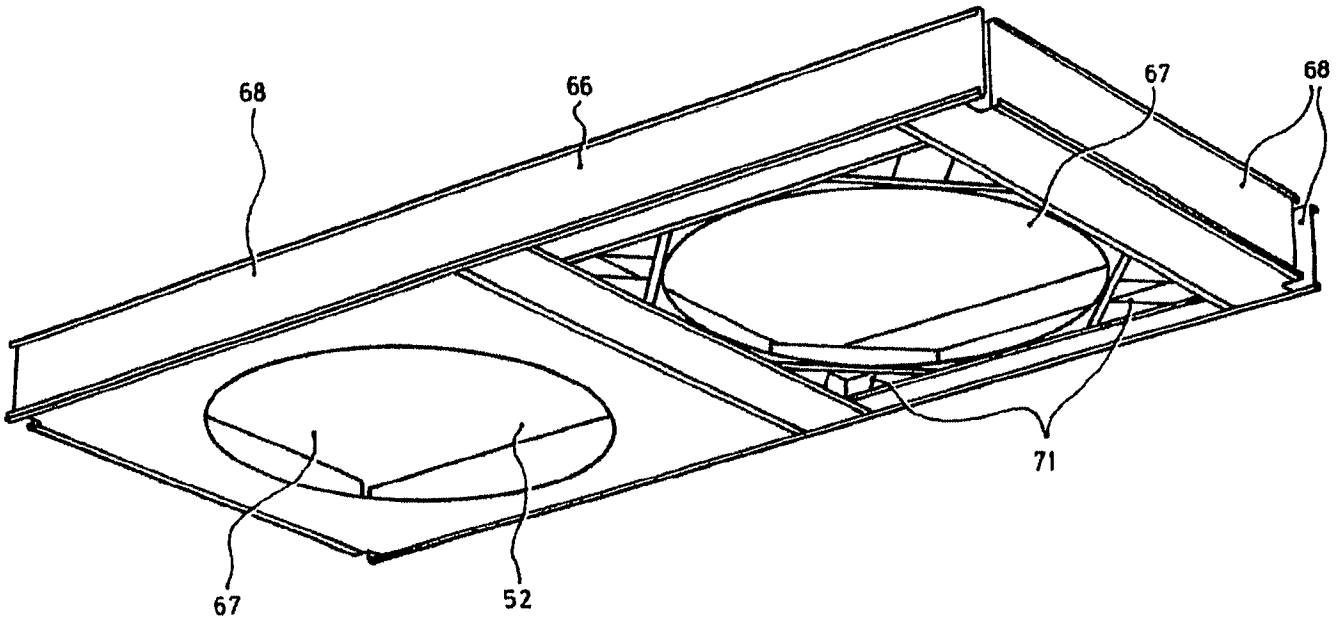
FIG. 21*a* shows a frame suitable for supporting two fans with four corner drives.

FIG. 21*a* shows a frame 66 comprising two holes 67 for accommodating two fans with four peripheral edge drives. Frame 66 has four upright edges 68 which also bound plenum chamber 52.

Four motor carriers 71 are adapted to carry the motors.

Figure 21B:
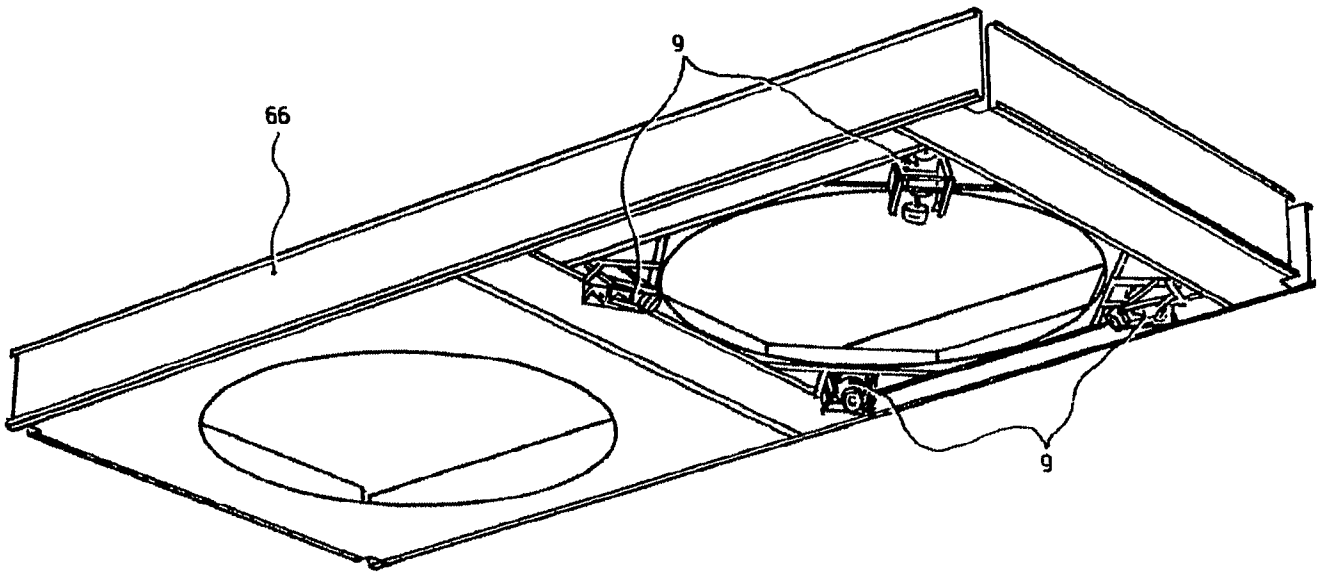
FIG. 21*b* shows a perspective view corresponding to FIG. 21*a* in which the four motors of a fan have been placed.

FIG. 21*b* shows the manner in which drive motors 9 are placed at the corners.

In reality they do not incline downward but upward under the influence of spring means, in particular gas springs, such that rotor 8 is supported resiliently.

Figure 21C:
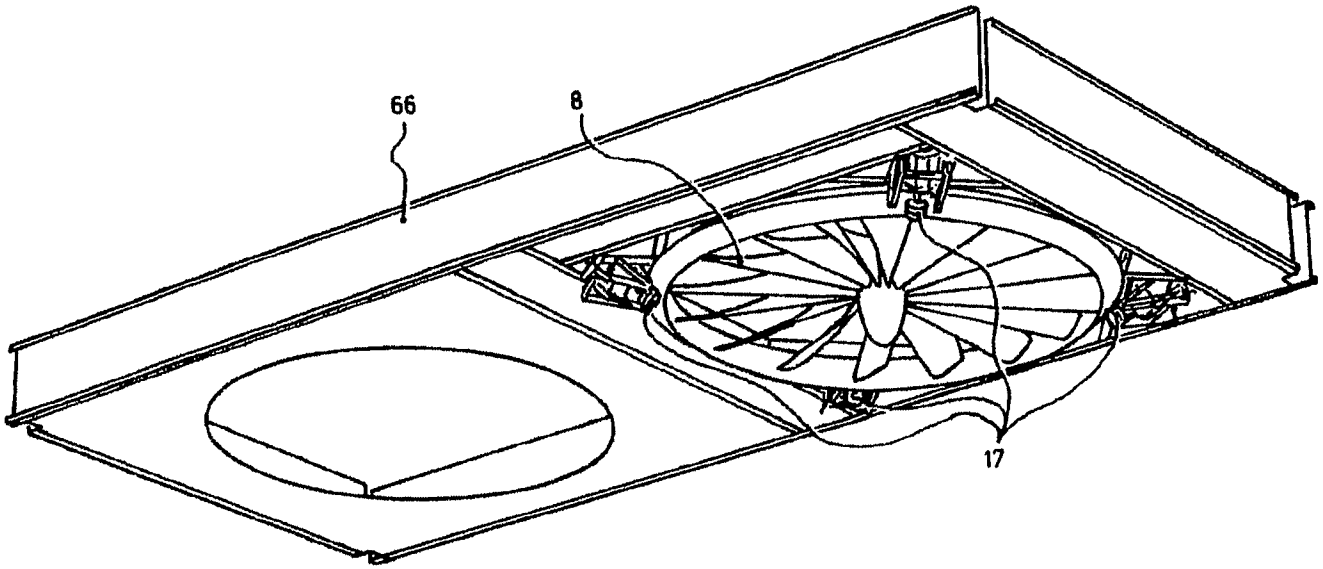
FIG. 21*c* shows a perspective view corresponding to FIG. 21*b* with a placed rotor.

FIG. 21*c* shows that drive wheels 17 support rotor 8 in the manner shown in FIG. 2*b*.

Figure 21D:
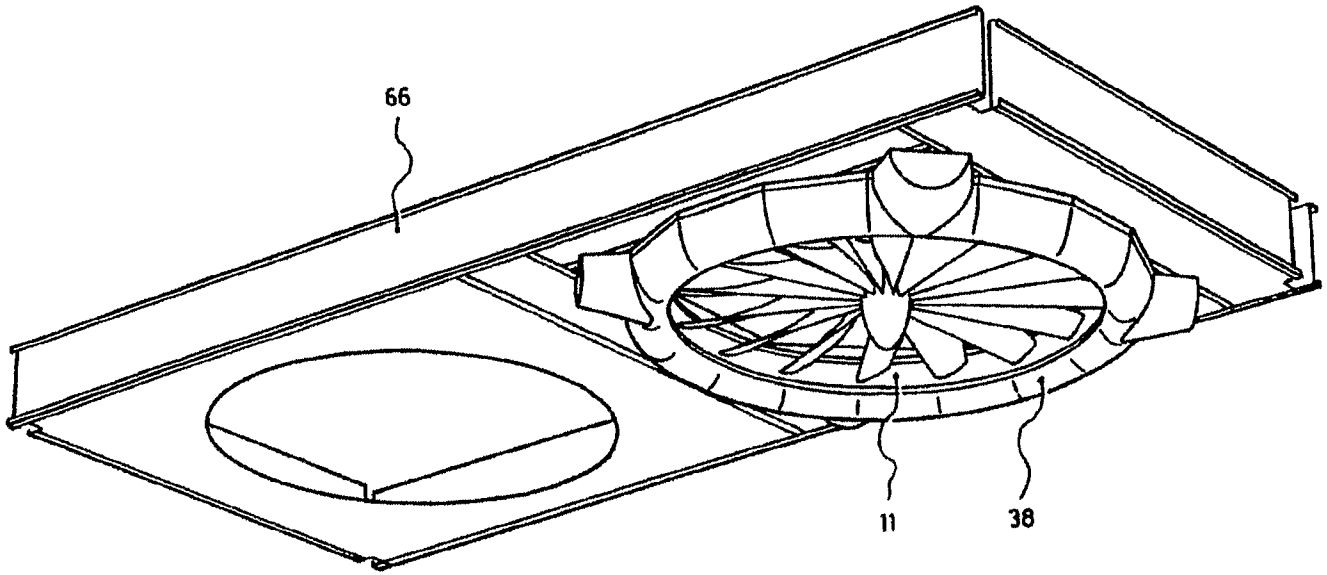
FIG. 21*d* shows a view corresponding to FIG. 21*c*, wherein the flow guide has been placed.

FIG. 21*d* shows that finally the ring 11 is covered by flow guide 38.

It will be apparent that the second fan is placed in the same manner in the remaining hole.

The performance of the fan according to the invention, with the same rotation speed and dimensioning, is substantially higher than in the prior art. The noise level of the generated sound is 10-20 dB SPL below that of the prior art.

The invention claimed is:

1. A fan, comprising:

a frame;

a rotor supported rotatably by the frame and having a central hub; and a number of substantially similar blades which are connected to the hub in an angularly equidistant arrangement and extend in a radial direction, which blades have an aerodynamic form such that during rotary driving of the rotor around an axis of the hub an air displacement occurs; and a drive mechanism for rotatably driving the blades with the hub around the axis of the hub;

a ring to which end zones of the blades are connected;

wherein the ring is assembled from two part-rings of a same form which each include a strip of sheet material with a form of a part of a circular arc, free ends of which are mutually connected such that each strip has a form of an outer surface of a truncated cone, which thus strips are mutually connected with an outer circular peripheral edge of the strips; and a third part-ring including a strip of sheet material which is bent into a round form and which mutually connects free circular inner edges of the first two part-rings;

the end zones of the blades are connected to the third part-ring;

the ring has a diameter of more than about 1.50 m;

a number of blades amounts to at least eight; and the blades are hollow and comprise a framework structure which is provided with a skin connected thereto.

2. The fan as claimed in claim 1, wherein the drive mechanism comprises a centrally disposed motor which drives the hub.

3. The fan as claimed in claim 1, wherein the drive mechanism comprises at least one decentrally disposed motor which drives the ring.

4. The fan as claimed in claim 3, comprising a number of motors distributed along the periphery of the fan.

5. The fan as claimed in claim 3, wherein the motor is elastically suspended.

6. The fan as claimed in claim 5, wherein the motor is urged toward a rotor ring by at least one gas spring.

7. The fan as claimed in claim 3, wherein the rotor is supported on the ring by wheels, of which at least one is driven by the motor.

8. The fan as claimed in claim 1, wherein the frame has a substantially square form and the corners left clear by the ring of the fan are provided with four respective drive motors.

9. The fan as claimed in claim 8, wherein the frame is connected to a heat exchanger corresponding with the form of the frame.

10. The fan as claimed in claim 3, wherein an output shaft of the motor bears a wheel with a toothing which co-acts in force-transmitting manner with a corresponding toothing on an outer surface of the ring.

11. The fan as claimed in claim 10, wherein the toothings are embodied as plastically twisted metal strips, and both have the same pitch.

12. The fan as claimed in claim 10, wherein the wheel has a conicity corresponding to a conicity of the ring and a central axis of the wheel extends in an axial or in radial direction relative to the rotor.

13. The fan as claimed in claim 10, wherein the wheel is substantially cylindrical, and a rotation axis of the wheel extends parallel to a describing line of a relevant conical surface of the ring.

14. The fan as claimed in claim 11, wherein contact surfaces, though not the toothings, of the wheel and the ring are covered with an elastic, vibration-damping material.

15. The fan as claimed in claim 14, wherein the material comprises polyurethane.

16. The fan as claimed in claim 1, wherein the part-rings comprise mutually coupled segments.

17. The fan as claimed in claim 1, wherein segments of the part-rings have mutually differing lengths, and therefore have an aperiodic arrangement.

18. The fan as claimed in claim 1, wherein connections between at least a number of component sheet metal parts of the ring are mutually connected by fingers which form part of the sheet metal parts and which are inserted through spaces present in co-acting parts.

19. The fan as claimed in claim 1, wherein the ring is stiffened internally by triangular plates.

20. The fan as claimed in claim 1, wherein a cavity defined by the ring is filled with a foam material.

21. The fan as claimed in claim 1, wherein the frame comprises a guide ring for aerodynamic guiding of the air flowing through the fan, which guide ring has a smoothly curved active surface which is coaxial with the rotor and has an annular recess with a form corresponding to a form of a rotor ring, the recess accommodating the rotor ring with some free clearance.

22. The fan as claimed in claim 21, wherein an upstream part of the active surface of the guide ring has a radial sectional form corresponding to a quarter of an ellipse, a longitudinal axis of which extends parallel to a central axis of the rotor.

23. The fan as claimed in claim 21, wherein the guide ring has a form on a downstream side such that a downstream flow through the fan is free of dead zones.

24. The fan as claimed in claim 1, wherein each blade is assembled from the framework, which carries the skin on an outer side of the framework such that the aerodynamic form of the blade is created.

25. The fan as claimed in claim 24, wherein the skin is comprised of metal.

26. The fan as claimed in claim 24, wherein the skin is embodied as a pre-fabricated fabric with fibre reinforcement.

27. The fan as claimed in claim 24, wherein the skin is non-woven.

28. The fan as claimed in claim 24, wherein the skin is comprised of aluminized polyester fabric.

29. The fan as claimed in claim 1, comprising a stationary, substantially rotation-symmetrical, nose cone which is disposed fixedly relative to the frame and which is disposed upstream relative to the huh and has an outer surface which widens from a front side to a rear side and which connects at the rear side to the hub in an aerodynamically smooth manner.

30. The fan as claimed in claim 29, wherein the longitudinal section of the outer surface has a form of a parabola, the extreme of which is situated at an upstream end of the nose cone.

31. The fan as claimed in claim 29, wherein the nose cone is supported by the frame via spokes.

32. The fan as claimed in claim 1, wherein the fan is provided on an inlet side with a protective grill.

33. The fan as claimed in claim 32, wherein the protective grill carries a nose cone.

34. The fan as claimed in claim 27, wherein the skin is also pre-impregnated.

* * * * *

UNITED STATES PATENT AND TRADEMARK OFFICE

CERTIFICATE OF CORRECTION

PATENT NO. : 8,961,109 B2
APPLICATION NO. : 12/681231
DATED : February 24, 2015
INVENTOR(S) : Augustinus Wilhelmus Maria Bertels It is certified that error appears in the above-identified patent and that said Letters Patent is hereby corrected as shown below:

In the Claims

Column 12, Line 42, Claim 29, delete “huh” and insert -- hub --

Signed and Sealed this
Ninth Day of June, 2015

Michelle K. Lee

Michelle K. Lee
*Director of the United States Patent and Trademark Office*